US009194353B2

(12) United States Patent
Kojima et al.

(10) Patent No.: US 9,194,353 B2
(45) Date of Patent: Nov. 24, 2015

(54) FUEL INJECTION CONTROL SYSTEM FOR INTERNAL COMBUSTION ENGINE

(75) Inventors: Susumu Kojima, Susono (JP); Keisuke Komori, Susono (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 302 days.

(21) Appl. No.: 13/980,327

(22) PCT Filed: Jan. 18, 2011

(86) PCT No.: PCT/JP2011/050775

§ 371 (c)(1),
(2), (4) Date: Jul. 18, 2013

(87) PCT Pub. No.: WO2012/098648

PCT Pub. Date: Jul. 26, 2012

(65) Prior Publication Data

US 2013/0298872 A1 Nov. 14, 2013

(51) Int. Cl.

| | |
|---|---|
| ***F02M 33/02*** | (2006.01) |
| ***F02M 69/00*** | (2006.01) |
| ***F02D 41/00*** | (2006.01) |

(Continued)

(52) U.S. Cl.

CPC ..... *F02M 69/00* (2013.01); *F02D 41/0025* (2013.01); *F02M 63/025* (2013.01); *F02D 41/0045* (2013.01); *F02D 2041/1409* (2013.01);

(Continued)

(58) Field of Classification Search

CPC ..... F02M 69/00; F02M 63/025; F02M 25/08; F02M 25/0836; F02D 41/0025; F02D 41/0042; F02D 41/0045; F02D 2041/1409

USPC ..... 123/456, 457, 446, 510, 511, 520, 123/339.1, 568.11, 568.21; 701/103, 108; 73/114.38, 114.39, 114.41, 114.42, 73/114.43

See application file for complete search history.

(56) References Cited

U.S. PATENT DOCUMENTS

| | | | | |
|---|---|---|---|---|
| 7,698,054 | B2 * | 4/2010 | Akita et al. | 701/113 |
| 2005/0172700 | A1 | 8/2005 | Sugiura | |

(Continued)

FOREIGN PATENT DOCUMENTS

| | | |
|---|---|---|
| JP | 04 153546 | 5/1992 |
| JP | 11 013568 | 1/1999 |

(Continued)

OTHER PUBLICATIONS

International Search Report Issued Apr. 19, 2011 in PCT/JP11/050775 Filed Jan. 18, 2011.

*Primary Examiner* — Hai Huynh

(74) *Attorney, Agent, or Firm* — Oblon, McClelland, Maier & Neustadt, L.L.P.

(57) ABSTRACT

An object of the invention is to provide a technology enabling to determine the saturation vapor pressure of used fuel in a fuel injection control system for an internal combustion engine equipped with a low pressure fuel pump and a high pressure fuel pump. In the invention, to achieve the object, in the fuel injection control system for an internal combustion engine that controls the duty cycle of the high pressure fuel pump by proportional-integral control based on the difference between the discharge pressure of the high pressure fuel pump and a target pressure, generation of vapor is detected based on a tendency of change in an integral term used in the proportional integral control, and the saturation vapor pressure of used fuel is calculated from the fuel temperature and the engine speed at that time.

11 Claims, 13 Drawing Sheets

(51) Int. Cl.
*F02M 63/02* (2006.01)
*F02D 41/14* (2006.01)

(52) U.S. Cl.
CPC . *F02D 2200/0602* (2013.01); *F02D 2200/0606* (2013.01); *F02M 2200/04* (2013.01)

(56) References Cited

U.S. PATENT DOCUMENTS

2007/0246025 A1 10/2007 Sato et al.
2008/0072880 A1* 3/2008 Wachtendorf et al. ..... 123/495
2011/0162622 A1 7/2011 Kojima et al.

FOREIGN PATENT DOCUMENTS

JP 2004 239064 8/2004
JP 2005 201068 7/2005
JP 2007 231813 9/2007
JP 2009 024569 2/2009
JP 2009 281211 12/2009
JP 2010 071224 4/2010
JP 2010 209728 9/2010

* cited by examiner

FUEL INJECTION CONTROL SYSTEM FOR INTERNAL COMBUSTION ENGINE

TECHNICAL FIELD

The present invention relates to a fuel injection control system for an internal combustion engine equipped with a low pressure fuel pump (or feed pump) and a high pressure fuel pump (or supply pump).

BACKGROUND ART

For use in a type of internal combustion engine in which fuel is injected directly into a cylinder, there has been known a fuel injection control system equipped with a low pressure fuel pump for sucking fuel from a fuel tank and a high pressure fuel pump for boosting the pressure of the fuel sucked by the low pressure pump to a pressure that allows injection into the cylinder.

In the above-described fuel injection control system, it is desired in order to reduce energy consumption in the operation of the low pressure fuel pump that the discharge pressure (or feed pressure) of the low pressure fuel pump be made as low as possible. However, if the pressure in a section between the low pressure fuel pump and the high pressure fuel pump becomes lower than the saturation vapor pressure of the fuel, vapor might be generated in the high pressure fuel pump.

As a countermeasure against this, Patent Document 1 describes a technology in which when the duty cycle of the high pressure fuel pump becomes equal to or larger than a predetermined value, the feed pressure is raised on the assumption that vapor is generated.

Patent Document 2 describes a technology in which a vapor pressure sensor is provided in the fuel tank and the fuel type is identified by comparing the measurement value of the vapor pressure sensor and measurement results obtained by measurements conducted in advance.

Patent Document 3 describes a technology in which the pressure and temperature of LPG in the fuel tank are measured by a fuel temperature sensor and a fuel pressure sensor, and a vapor pressure curve of the LPG in use is determined by comparing the measurement results with previously stored vapor pressure curves.

Patent Document 4 describes a technology pertaining to a vaporized fuel processing apparatus for supplying vaporized fuel generated in the fuel tank to the intake system of the internal combustion engine. In this technology, the vaporized fuel concentration in the mixture is obtained and the volatility of the fuel is determined based on the vaporized fuel concentration thus obtained.

Patent Document 5 describes a technology in which a temperature sensor for measuring the temperature in the fuel tank, a pressure sensor for measuring the pressure in the fuel tank and a density sensor for measuring the density of fuel supplied to the internal combustion engine are prepared and the octane number of the fuel is determined based on the results of measurement by the sensors at the time of the first start-up after fuelling.

Patent Document 6 describes a technology in which a heater for heating the fuel taken into a fuel identification chamber from a fuel passage to a predetermined temperature and a temperature sensor for measuring the temperature of the heated fuel are prepared and properties of the fuel are identified based on the results of measurement by the temperature sensor and pressure sensor.

Patent Document 7 describes a technology in which when mis-fuelling is found based on the result of identification of fuel properties, emergency driving is enabled by increasing the idle engine speed of the internal combustion engine and prohibiting high load driving.

Patent Document 8 describes a technology in which when a low octane fuel is used, the fuel injection timing is retarded, the fuel injection pressure is raised, and the ignition timing is advanced, thereby avoiding pre-ignition and preventing the torque decrease.

Patent Document 9 describes a technology in which a calculation model for calculating the fractionated amount of a fuel based on the saturation vapor pressures of a plurality of components contained in the fuel and the mix proportion of the plurality of components is prepared, and a mixture proportion at which the value calculated according to the calculation model becomes equal to a fractionated amount measured in advance is determined.

CITATION LIST

Patent Literature

PTL 1: Japanese Patent Application Laid-Open No. 2010-071224

PTL 2: Japanese Patent Application Laid-Open No. 2005-201068

PTL 3: Japanese Patent Application Laid-Open No. 2004-239064

PTL 4: Japanese Patent Application Laid-Open No. 2007-231813

PTL 5: Japanese Patent Application Laid-Open No. 2009-281211

PTL 6: Japanese Patent Application Laid-Open No. H11-013568

PTL 7: Japanese Patent Application Laid-Open No. 2009-024569

PTL 8: Japanese Patent Application Laid-Open No. 2010-209728

PTL 9: Japanese Patent Application Laid-Open No. H04-153546

SUMMARY OF INVENTION

Technical Problem

In the system described in the Patent Document 1, when the duty cycle of the high pressure fuel pump is not lower than a predetermined value, there is a possibility that the pressure in the section between the low pressure fuel pump and the high pressure fuel pump is much lower than the saturation vapor pressure. When this is the case, an excessively large amount of vapor will be generated, and the fuel pressure in the high pressure fuel passage will become low. Consequently, a miss fire and/or a deviation of the air-fuel ratio might be unavoidable.

The present invention has been made in view of the above-described situation, and its object is to provide a technology that enables determination of the saturation vapor pressure of fuel in a fuel injection control system for an internal combustion engine equipped with a low pressure fuel pump and a high pressure fuel pump.

Solutions to Problem

In the present invention, to solve the above-described problem, we focused on fact that in a fuel injection control system for an internal combustion engine in which the duty cycle of a high pressure fuel pump is proportional-integral controlled (PI-controlled) based on the difference between the discharge pressure of the high pressure pump and a target pressure, an integral term (I term) used in the proportional-integral control exhibits a peculiar behavior at the time when vapor is generated.

Specifically, the present invention provides a fuel injection control system for an internal combustion engine in which fuel discharged from a low pressure fuel pump is supplied to a fuel injection valve with its pressure boosted by a high pressure fuel pump, comprising:

a processing unit that executes a lowering process of lowering the discharge pressure of the low pressure fuel pump;

a first pressure sensor that measures the discharge pressure of the low pressure fuel pump;

a temperature sensor that measures the temperature of fuel discharged from the low pressure fuel pump;

a second pressure sensor that measures the discharge pressure of the high pressure fuel pump;

a control unit that performs proportional-integral control of the duty cycle of the high pressure fuel pump based on the difference between a target discharge pressure of the high pressure fuel pump and a measurement value of the second pressure sensor;

a detection unit that detects generation of vapor based on a tendency of change in an integral term used in the proportional-integral control during the execution of the lowering process; and a calculation unit that calculates the saturation vapor pressure of fuel from a measurement value of the first pressure sensor and a measurement value of the temperature sensor at the time when the detection unit detects generation of vapor.

The inventor of the present invention had conducted experiments and verifications strenuously to find that in the case where the duty cycle of the high pressure fuel pump is feedback-controlled by a proportional-integral control, the integral term in the proportional-integral control exhibits a distinct increasing tendency at the time when vapor starts to be generated, in other words even at the time when a small amount of vapor is generated.

Therefore, according to the present invention, the generation of vapor can be detected based on a tendency of change in the integral term used in the proportional-integral control, and the saturation vapor pressure of fuel can be determined based on the measurement value of the first pressure sensor and the fuel temperature at that time.

As the quantity of fuel sucked by the high pressure fuel pump per unit time (or suction rate) increases, the pressure of fuel sucked by the high pressure fuel pump becomes lower than the discharge pressure (or feed pressure) of the low pressure fuel pump. Therefore, at the time of the generation of vapor, the measurement value of the first pressure sensor will be higher than the pressure of fuel sucked by the high pressure fuel pump. In such cases, if the saturation vapor pressure is calculated based on the measurement value of the first pressure sensor, the calculated value of the saturation vapor pressure might be higher than the actual saturation vapor pressure.

Therefore, it is desirable that the saturation vapor pressure calculated based on the measurement value of the first pressure sensor be corrected in relation to the suction rate of the high pressure fuel pump. In this connection, since the suction rate of the high pressure fuel pump correlates with the engine speed, the saturation vapor pressure calculated based on the measurement value of the first pressure sensor may be corrected in relation to the engine speed. The method of this correction may be either correcting the measurement value of the first pressure sensor used in calculating the saturation vapor pressure in relation to the engine speed or correcting the saturation vapor pressure calculated based on the measurement value of the first pressure sensor in relation to the engine speed. By performing correction using such a method, the saturation vapor pressure of the used fuel can be determined more accurately.

Properties of fuel used in an internal combustion engine might change by, for example, fuelling. As properties of the used fuel change, the saturation vapor pressure will change accordingly. The target discharge pressure (or target feed pressure) of the low pressure fuel pump is set based on the saturation vapor pressure of a fuel (which will be hereinafter referred to as the "standard fuel") having presupposed properties. Therefore, if a fuel having properties different from those of the standard fuel is used, the target feed pressure might be inappropriate for the used fuel. When this is the case, there is a possibility that vapor may be liable to be generated before the feedback control takes effect or that the target feed pressure may be excessively high relative to the saturation vapor pressure. In consequence, a miss fire and/or a deviation of the air-fuel ratio might occur, and/or the power consumption of the low pressure fuel pump might increase.

According to the present invention, the saturation vapor pressure of the used fuel can be determined even if properties of the used fuel are different from those of the standard fuel. Therefore, it is possible to set a target discharge pressure (or target feed pressure) of the low pressure fuel pump that is suitable for the saturation vapor pressure of the used fuel. For example, the fuel injection control system for an internal combustion engine according to the present invention may further comprise a setting unit that sets a target discharge pressure of the low pressure fuel pump in relation to the saturation vapor pressure calculated by the calculation unit.

In this case, when the saturation vapor pressure (or the saturation vapor pressure of the used fuel) calculated by the calculation unit is higher than the saturation vapor pressure of the standard fuel, the setting unit may make the target discharge pressure higher than that in the case where the standard fuel is used. On the other hand, when the saturation vapor pressure calculated by the calculation unit is lower than the saturation vapor pressure of the standard fuel, the setting unit may make the target discharge pressure lower than that in the case where the standard fuel is used.

By this method, it is possible to set a value of the target discharge pressure of the low pressure fuel pump suitable for the saturation vapor pressure of the used fuel. In consequence, the target discharge pressure of the low pressure fuel pump is set as low as possible within the range in which vapor is not generated.

The above-described setting unit may be adapted to estimate a saturation vapor pressure curve of the actually used fuel based on the saturation vapor pressure of the standard fuel and the saturation vapor pressure calculated by the calculation unit and to set the target discharge pressure of the low pressure fuel pump based on the saturation vapor pressure curve thus estimated. The "saturation vapor pressure curve" mentioned here may be obtained as either a function in the form of a mathematical equation expressing the correlation between the saturation vapor pressure and the fuel temperature or a map in which the correlation between the saturation vapor pressure and the fuel temperature is plotted. Alternatively, the "saturation vapor pressure curve" may be either a function that calculates the difference between the saturation vapor pressure of the standard fuel and the saturation vapor pressure of the used fuel using the fuel temperature as an argument (or parameter) or a map in which the correlation between the difference and the fuel temperature is plotted.

By obtaining the saturation vapor pressure curve of the used fuel by one of the above-described various methods, the value of the target discharge pressure of the low pressure fuel pump can be adapted to properties (saturation vapor pressure) of the used fuel even if the temperature of the fuel changes. Thus, the target discharge pressure of the low pressure fuel pump will be set as low as possible within the range in which vapor is not generated.

When the internal combustion engine is in a cold state, an increasing correction for increasing the fuel injection quantity is sometimes performed. There is a possibility that the correction amount in that correction may be set relatively large so that the ignitability and combustion stability are not deteriorated even in cases where a fuel heavier than the standard fuel is used. However, when the fuel actually used is light, the correction amount is too large, leading to an unwanted increase in the fuel consumption.

In view of this, the fuel injection control system for an internal combustion engine according to the present invention may further comprise an increasing correction unit that performs an increasing correction of the fuel injection quantity when the internal combustion engine is in a cold state, and the increasing correction unit may make the correction amount smaller when the saturation vapor pressure calculated by the calculation unit is high than when the saturation vapor pressure calculated by the calculation unit is low.

The saturation vapor pressure tends to be higher in cases where the fuel is characteristically light than in cases where the fuel is characteristically heavy. Therefore, by making the correction amount (or the increase in the fuel injection quantity) smaller when the saturation vapor pressure calculated by the calculation unit is high than when the saturation vapor pressure calculated by the calculation unit is low, it is possible to reduce the fuel consumption without deteriorating the ignitability and combustion stability.

Properties (saturation vapor pressure) of the used fuel is liable to change on the occasion of fuelling. Therefore, in the fuel injection control system for an internal combustion engine according to the present invention, the execution of the process of detecting the generation of vapor by the detection unit may be triggered by fuelling, and the calculation unit may be adapted to calculate the saturation vapor pressure of fuel from the measurement value of the first pressure sensor and the measurement value of the temperature sensor at the time of the generation of vapor. With this feature, a change in fuel properties (saturation vapor pressure) caused by fuelling can be detected promptly.

There is a possibility that light components contained in fuel may evaporate with the lapse of time. If light components in fuel evaporate, properties (saturation vapor pressure) of fuel might change (or decrease). In view of this, in the fuel injection control system for an internal combustion engine according to the present invention, a process of determining the saturation vapor pressure may be executed at the time when the amount of vaporized fuel reaches or becomes larger than a predetermined specific amount.

For example, in the case of an internal combustion engine equipped with a purge apparatus for supplying vaporized fuel generated in the fuel tank to the intake system and a purge correction unit that performs a decreasing correction of the fuel injection quantity according to the quantity of vaporized fuel supplied by the purge apparatus, the process of determining the saturation vapor pressure (including the process of detecting the generation of vapor by the detection unit and the process of calculating the saturation vapor pressure by the calculation unit) may be executed at the time when the integrated value of the correction amount in the purge correction unit reaches a specific amount. By this method, even if a property (saturation vapor pressure) of fuel changes due to the evaporation of light components in the fuel, the saturation vapor pressure after the change can be determined promptly.

The fuel injection control system for an internal combustion engine according to the present invention may further comprise a heating apparatus that heats the fuel flowing into the high pressure fuel pump, and the heating apparatus may be caused to operate when the process of detecting the generation of vapor is executed by the detection unit.

The saturation vapor pressure of fuel tends to be higher when the temperature of fuel is high than when the temperature of fuel is low. Therefore, vapor is harder to be generated when the temperature of fuel is low than when the temperature of fuel is high. In addition, the difference in the saturation vapor pressure resulting from the difference in fuel properties is smaller when the fuel temperature is low than when the fuel temperature is high.

Heating fuel when executing the process of determining the saturation vapor pressure facilitates the generation of vapor and makes the difference in the saturation vapor pressure resulting from the difference in fuel properties large. In consequence, the chances of determination of the saturation vapor pressure increase, and it is possible to determine the difference in the saturation vapor pressure resulting from the difference in fuel properties more accurately.

There is a possibility that a user may mistakenly feed a nonstandard fuel when fuelling. For example, light oil might be fed as fuel to an internal combustion engine whose standard fuel is gasoline or gasoline might be fed as fuel to an internal combustion engine whose standard fuel is light oil. For instance, in the case where light oil is fed as fuel to an internal combustion engine whose standard fuel is gasoline, knocking might occur due to a decrease in the octane number or miss fire and deterioration in the combustion stability might be caused due to a decrease in the volatility. On the other hand, if gasoline is fed as fuel to an internal combustion engine whose standard fuel is light oil, seizing of the fuel pump (high pressure fuel pump, especially) might be caused due to a decrease in the lubricity of fuel.

Since the light oil is heavier than gasoline, in the case where light oil is fed as fuel to an internal combustion engine whose standard fuel is gasoline, the saturation vapor pressure calculated by the calculation unit will be much lower than the saturation vapor pressure of the standard fuel. In view of this, the fuel injection control system for an internal combustion engine according to the present invention may further comprise a compensation unit that executes at least one of the following processes when the saturation vapor pressure calculated by the calculation unit is lower than the saturation vapor pressure of the standard fuel: a process of retarding the ignition timing, a process of increasing the internal EGR gas and a process of raising the fuel injection pressure.

In the case where the ignition timing is retarded, knocking can be prevented from occurring. In the case where the internal EGR gas is increased, the temperature in the cylinder will rise, promoting the evaporation of fuel. In the case where the fuel injection pressure is raised, fuel will be atomized, promoting the evaporation of fuel.

Properties (saturation vapor pressure) of gasoline might vary depending on its preparation process. Therefore, if the compensation unit executes the above-described process when a gasoline having a saturation vapor pressure a little lower than that of the standard fuel is fed, there is a possibility that the operation of the internal combustion engine will become rather unstable. In view of this, the compensation unit may be adapted to execute the above-described processes on condition that the difference between the saturation vapor pressure calculated by the calculation unit and the saturation vapor pressure of the standard fuel exceeds an upper limit value. It is desirable that the upper limit value in this case be set in relation to the difference between the saturation vapor pressure of gasoline and the saturation vapor pressure of light oil.

If gasoline is fed as fuel to an internal combustion engine whose standard fuel is light oil, the saturation vapor pressure calculated by the calculation unit will be much higher than that of the standard fuel. In view of this, the fuel injection control system for an internal combustion engine according to the present invention may further comprise a restriction unit that restricts the output of the internal combustion engine when the saturation vapor pressure calculated by the calculation unit is higher than the saturation vapor pressure of the standard fuel.

It is desirable that the restriction of the output include the restriction in terms of the torque generated by the internal combustion engine and the restriction in terms of the engine speed of the internal combustion engine. Restrictions of the torque generated by the internal combustion engine and the engine speed will lighten the load on the fuel pump. Consequently, it will become possible to prevent the fuel pump from seizing due to a decrease in the lubricity of fuel.

Properties (saturation vapor pressure) of light oil might also vary as with gasoline. Therefore, the restriction unit may be adapted to restrict the output and engine speed of the internal combustion engine on condition that the difference between the saturation vapor pressure calculated by the calculation unit and the saturation vapor pressure of the standard fuel exceeds an upper limit value.

If a fuel that is much lighter than the standard fuel is fed, the amount of vaporized fuel will increase greatly. When the amount of vaporized fuel increases, it is necessary to increase the quantity of vaporized fuel supplied to the intake system by the purge apparatus. However, when the internal combustion engine is idling, it is not allowed to supply a large quantity of vaporized fuel to the intake system because the quantity of fuel needed for combustion is small. Therefore, there is a possibility that failures such as emission of surplus vaporized fuel to the atmosphere may be caused.

In view of this, the fuel injection control system for an internal combustion engine according to the present invention may further comprise an idle-up control unit that performs increasing correction of the idle speed of the internal combustion engine when the saturation vapor pressure calculated by the calculation unit is higher than the saturation vapor pressure of the standard fuel. With this feature, the quantity of vaporized fuel supplied to the intake system of the internal combustion engine can be increased when the internal combustion engine is idling. In consequence, failures such as emission of surplus vaporized fuel to the atmosphere can be eliminated.

Advantageous Effects of Invention

According to the present invention, it is possible to detect the saturation vapor pressure of fuel in a fuel injection control system for an internal combustion engine equipped with a low pressure fuel pump and a high pressure fuel pump.

DESCRIPTION OF EMBODIMENTS

In the following, specific embodiments of the present invention will be described with reference to the drawings. The dimensions, materials, shapes and relative arrangements etc. of the components that will be described in connection with the embodiments are not intended to limit the technical scope of the present invention only to them, unless particularly stated.

Embodiment 1

Figure 1:
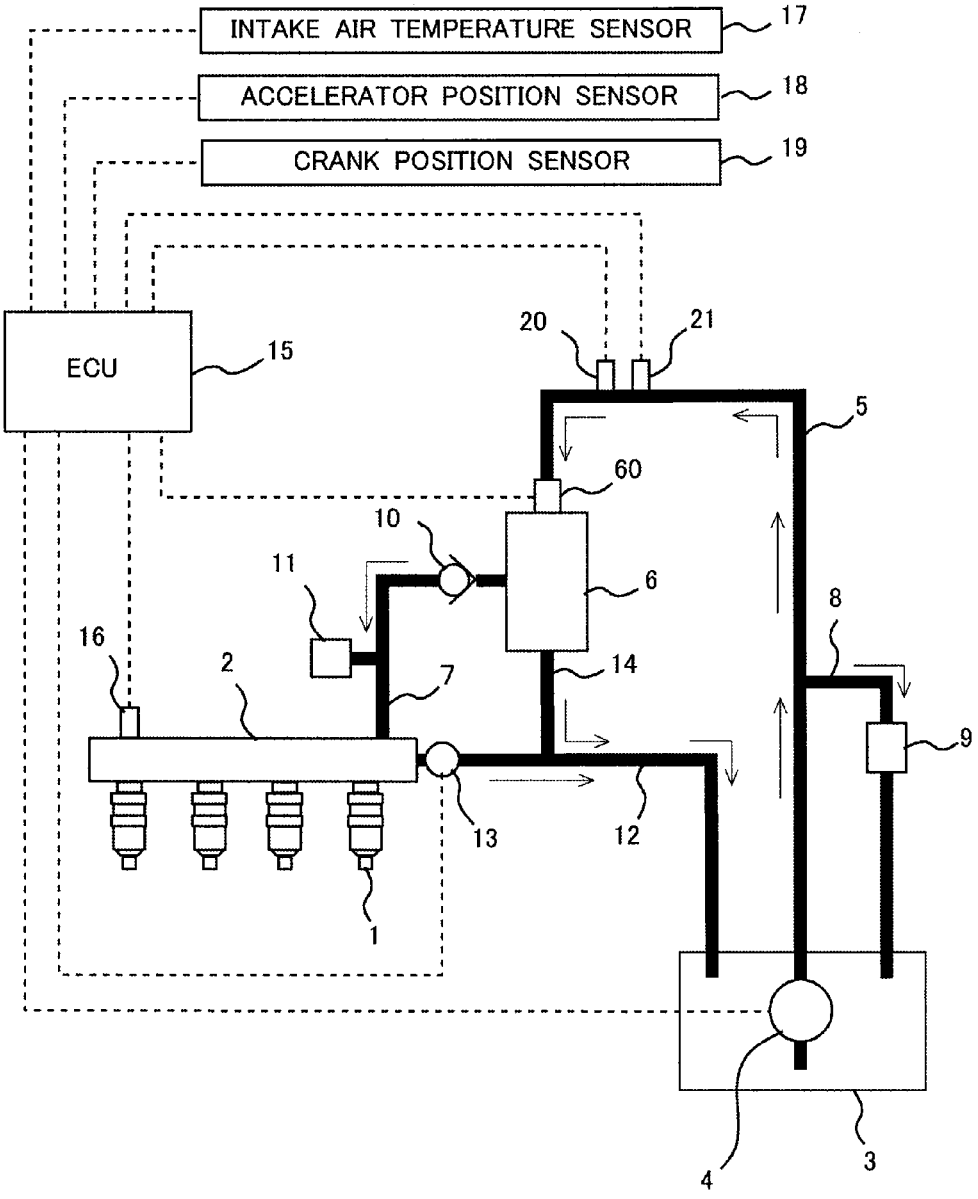
FIG. 1 is a diagram showing the basic configuration of the fuel injection system of an internal combustion engine to which the present invention is applied.

A first embodiment of the present invention will be firstly described with reference to FIGS. 1 to 8. FIG. 1 is a diagram showing the basic configuration of a fuel injection control system for an internal combustion engine. In FIG. 1, the fuel injection control system has fuel injection valves 1 for injecting fuel into cylinders of the internal combustion engine. The fuel injection valves 1 are connected to a delivery pipe 2. Although four fuel injection valves 1 are connected to the delivery valve in the case illustrated in FIG. 1, the number of fuel injection valves 1 may be five or more or three or less.

The fuel injection control system has a low pressure fuel pump 4 that pumps up fuel stored in a fuel tank 3. The low pressure fuel pump 4 is a rotary pump that is driven by an electric motor. Low pressure fuel discharged from the low pressure pump 4 is delivered to an inlet port of a high pressure pump 6 through a low pressure fuel passage 5.

The high pressure fuel pump 6 is a reciprocating pump (plunger pump) that is driven by the power of the internal combustion engine (e.g. by means of rotational force of a cam shaft). An inlet valve 60 for switching between opening and closing of the inlet port is provided at the inlet port of the high pressure fuel pump 6. The inlet valve 60 is an electromagnetic valve mechanism that changes the discharge rate of the high pressure fuel pump 6 by changing the opening/closing timing relative to the position of the plunger. To the discharge port of the high pressure pump 6 is connected the upstream end of a high pressure fuel passage 7. The downstream end of the high pressure fuel passage 7 is connected to the delivery pipe 2.

To the middle of the low pressure fuel passage 5 is connected the upstream end of a branch passage 8. The downstream end of the branch passage 8 is connected to the fuel tank 3. A pressure regulator 9 is provided in the middle of the branch passage 8. The pressure regulator 9 is adapted to open when the pressure (fuel pressure) in the low pressure fuel passage 5 exceeds a predetermined value, thereby returning surplus fuel in the low pressure fuel passage 5 to the fuel tank 3 through the branch passage 8.

A check valve 10 and a pulsation damper 11 are provided in the middle of the high pressure passage 7. The check valve 10 is a one way valve that allows the flow from the discharge port of the high pressure fuel pump 6 toward the delivery pipe 2 and restricts the flow from the delivery pipe 2 toward the discharge port of the high pressure fuel pump 6. The pulsation damper 11 is used to damp the pulsation of fuel caused with the operation (i.e. sucking and discharging) of the high pressure fuel pump 6.

To the delivery pipe 2 is connected a return passage 12 for returning surplus fuel in the delivery pipe 2 to the fuel tank 3. A relief valve 13 for switching between opening and closing of the return passage 12 is provided in the middle of the return passage 12. The relief valve 13 is an electric or electromagnetic valve mechanism that is opened when the fuel pressure in the delivery pipe 2 exceeds a target value.

To the middle of the return passage 12 is connected the downstream end of a communication passage 14. The upstream end of the communication passage 14 is connected to the high pressure fuel pump 6. The communication passage 14 is a passage for letting surplus fuel discharged from the high pressure fuel pump 6 flow into the return passage 12.

The fuel injection control system has an electronic control unit (ECU) 15 that controls the above-described components. The ECU 15 is electrically connected with various sensors such as a fuel pressure sensor 16, an intake air temperature sensor 17, an accelerator position sensor 18, a crank position sensor 19, a fuel temperature sensor 20, and a feed pressure sensor 21.

The fuel pressure sensor 16 is a sensor that outputs an electrical signal correlating with the fuel pressure in the delivery pipe 2 (or the discharge pressure of the high pressure fuel pump) and corresponds to the second pressure sensor according to the present invention. The fuel pressure sensor 16 may be provided in the high pressure fuel passage 7. The intake air temperature sensor 17 outputs an electrical signal correlating with the temperature of air taken into the internal combustion engine. The accelerator position sensor 18 outputs an electrical signal correlating with the amount of operation of the accelerator pedal (or the accelerator opening degree). The crank position sensor 19 is a sensor that outputs an electrical signal correlating with the rotational position of the output shaft (or the crankshaft) of the internal combustion engine. The fuel temperature sensor 20 is a sensor that outputs an electrical signal correlating with the temperature of fuel flowing in the low pressure fuel passage 5 and corresponds to the temperature sensor according to the present invention. The feed pressure sensor 21 is a sensor that outputs an electrical signal correlating with the discharge pressure (or the feed pressure) of the low pressure fuel pump 4 and corresponds to the first pressure sensor according to the present invention.

The ECU 15 controls the low pressure fuel pump 4 and the inlet valve 60 based on the signals output from the above-described various sensors. For instance, the ECU 15 adjusts the opening/closing timing of the inlet valve 60 in such a way that the output signal of the fuel pressure sensor 16 (i.e. the actual fuel pressure) converges to a target value. In doing so, the ECU 15 performs a proportional-integral control (PI control) of the duty cycle (i.e. the ratio of the energized period and the non-energized period in a solenoid) as a control quantity of the inlet valve 60 based on the difference between the actual fuel pressure and a target value. The aforementioned target value is determined as a function of the desired fuel injection quantity through the fuel injection valve 1.

In the above-described proportional-integral control, the ECU 15 calculates the duty cycle by adding a control value (or feed forward term) determined according to the desired fuel injection quantity, a control value (or proportional term) determined according to the difference between the actual fuel pressure and the target value (which will be hereinafter referred to as the "fuel pressure difference") and a control value (or integral term) obtained by integrating a part of the difference between the actual fuel pressure and the target value. This calculation of the duty cycle by the ECU 15 embodies the control unit according to the present invention.

The relationship between the fuel pressure difference and the feed forward term and the relationship between the fuel pressure difference and the proportional term shall be determined in advance by an adaptation process utilizing an experiment etc. The proportion of the fuel pressure difference to be integrated to the integral term shall also be determined in advance by an adaptation process utilizing an experiment etc.

The ECU 15 executes a process (lowering process) of lowering the target discharge pressure (or target feed pressure) of the low pressure fuel pump 4 in order to reduce the power consumption of the low pressure fuel pump 4 as much as possible. Specifically, the ECU 15 firstly sets a default value of the target feed pressure based on the operation state of the internal combustion engine and the fuel temperature etc. Thereafter, the ECU 15 lowers the target feed pressure by a constant step (which will be hereinafter referred to as the "lowering factor"). It is desirable that the lowering factor be set to be as high as possible so long as the fuel pressure in the low pressure fuel passage 5 is not made much lower than the saturation vapor pressure. It is desirable that the lowering factor be obtained in advance by an adaptation process such as an experiment.

There may be cases in which the default value of the target feed pressure is set on the assumption that a fuel (or standard fuel) having a relatively high saturation vapor pressure is used. On the other hand, there may be cases in which the fuel that is actually used (or used fuel) has a saturation vapor pressure lower than that of the standard fuel. In such cases, the default value of the target feed pressure might be excessively high relative to the saturation vapor pressure of the used fuel. Then, there is a possibility that the effect of the lowering process may be difficult to be achieved.

In view of the above, in this embodiment the saturation vapor pressure of the fuel is determined utilizing as a parameter the tendency of change in the integral term that is used in calculating the duty cycle of the high pressure fuel pump 6, and a correction of the target feed pressure of the low pressure fuel pump 4 is performed based on the saturation vapor pressure thus determined. The "correction of the target feed pressure" mentioned here includes not only a correction of a command value given to the low pressure pump 4 but also a correction of the target feed pressure stored (as the default value) in, for example, a ROM of the ECU 15.

In the following, a method of correcting the target feed pressure of the low pressure fuel pump 4 will be described.

Figure 2:
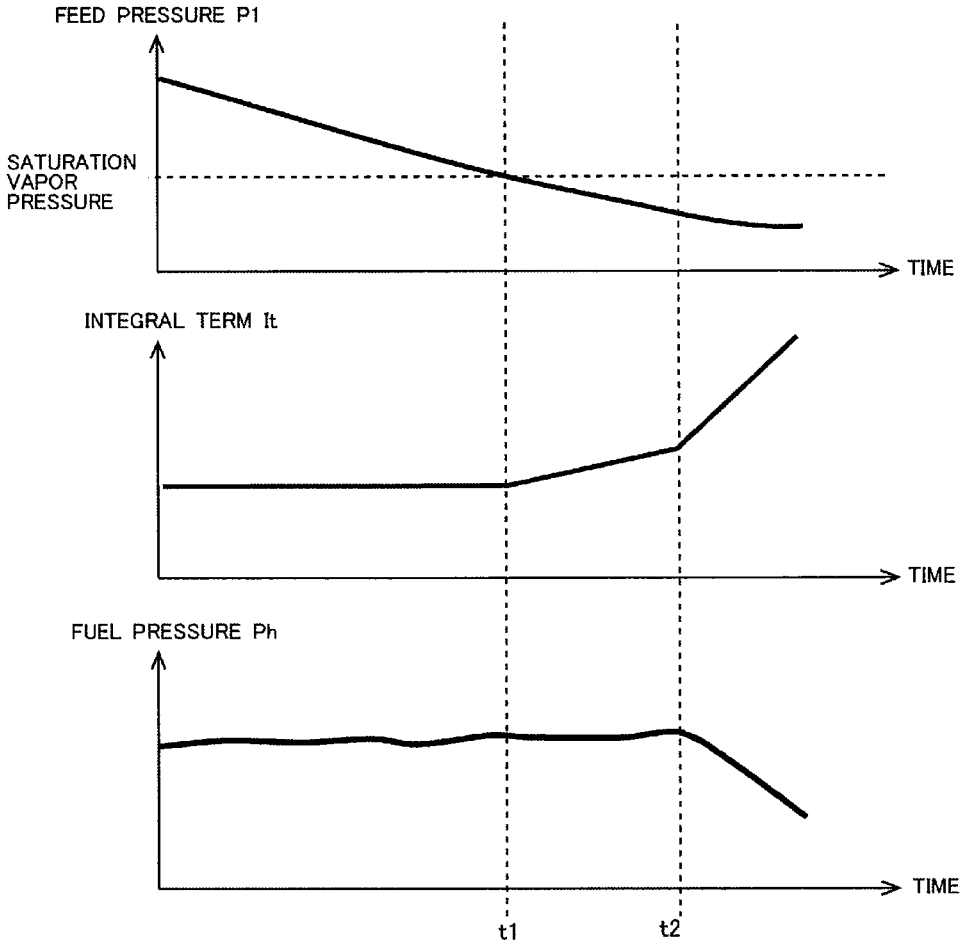
FIG. 2 shows behaviors of the integral term It and the fuel pressure Ph in the high pressure fuel passage with a decrease in the discharge pressure (or feed pressure) of the low pressure fuel pump.

FIG. 2 shows the behavior of the integral term It and the fuel pressure Ph in the high pressure fuel passage 7 with a continuous decrease in the feed pressure Pl. In FIG. 2, as the feed pressure Pl becomes lower than the saturation vapor pressure (at t1 in FIG. 2), the integral term It exhibits a moderate increasing tendency. With a further decrease in the feed pressure Pi, a suction failure or a discharge failure occurs in the high pressure fuel pump 6 (at t2 in FIG. 2). When a suction failure or a discharge failure occurs in the high pressure fuel pump 6, the increasing rate of the integral term It becomes higher and the fuel pressure Ph in the high pressure fuel passage 7 decreases.

A consideration of the relationship shown in FIG. 2 suggests a method of determination in which it is determined that vapor is generated (namely, the fuel pressure in the low pressure fuel passage 5 becomes lower than the saturation vapor pressure) at the time when the magnitude (or absolute value) of the integral term It exceeds a threshold value. However, the magnitude of the integral term It is increased not only by the generation of vapor but also by a rise in the fuel temperature or an increase in the target injection quantity.

Therefore, in order to detect the generation of vapor more correctly, it is preferred that the determination as to the generation of vapor be made based on the tendency of change in the integral term It per certain time period (for example, per execution cycle of the lowering process or per cycle of calculation of the duty cycle of the high pressure fuel pump 6). Specifically, a preferred method is that it is determined that vapor is not generated if the integral term It is constant or in a decreasing tendency and that vapor is generated if the integral term It is in an increasing tendency. This method enables detecting the generation of vapor before a suction failure or a discharge failure occurs in the high pressure fuel pump 6 (for example in the period from t1 to t2 in FIG. 2).

When the generation of vapor is detected by the above-described method, the saturation vapor pressure can be calculated using as parameters the measurement value of the feed pressure sensor 21 and the measurement value of the fuel temperature sensor 20 at the time of the generation of vapor.

The pressure in the low pressure fuel passage 5 might sometimes change depending not only on the feed pressure but also on the suction rate of the high pressure fuel pump 6 (i.e. the quantity of fuel sucked by the high pressure fuel pump 6 per unit time). For example, as the suction rate of the high pressure fuel pump 6 becomes high, the fuel pressure in the low pressure fuel passage 5 becomes lower than the feed pressure of the low pressure fuel pump 4. In consequence, the measurement value of the feed pressure sensor 21 will become higher than the fuel pressure at the time when vapor is generated. Consequently, if the saturation vapor pressure is calculated using as a parameter the measurement value of the feed pressure sensor 21, the calculated value of the saturation vapor pressure will be higher than the actual saturation vapor pressure.

In view of this, it is desirable that the measurement value of the feed pressure sensor 21 or the calculated value of the saturation vapor pressure be corrected in relation to the suction rate of the high pressure fuel pump 6. Since the suction rate of the high pressure fuel pump 6 correlates with the speed (or engine speed) of the internal combustion engine, the measurement value of the feed pressure sensor 21 or the calculated value of the saturation vapor pressure may be corrected in relation to the engine speed.

If the saturation vapor pressure of the fuel has been determined, the command value (i.e. driving current) supplied to the low pressure fuel pump 4 can be corrected so that the fuel pressure in the low pressure passage 5 does not become lower than the saturation vapor pressure. In the case where a saturation vapor pressure stored in the ROM or the like in the ECU 15 in advance is to be corrected, a saturation vapor pressure curve of the used fuel may be estimated.

Figure 3:
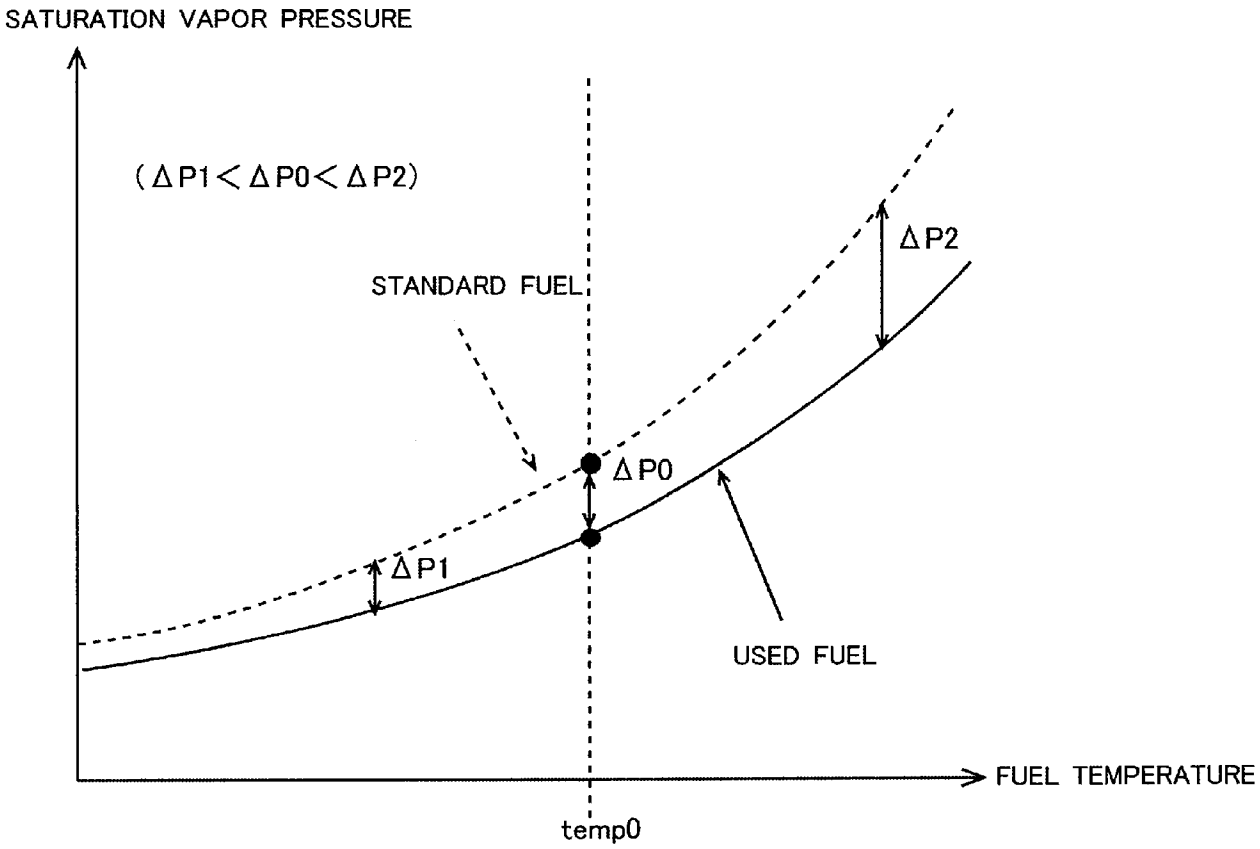
FIG. 3 illustrates a method of estimating a saturation vapor pressure curve of the used fuel.

In one method of estimating the saturation vapor pressure curve that may be adopted, as shown in FIG. 3, the curve is estimated in such a way that based on as a reference the difference ΔP0 between the saturation vapor pressure of the standard fuel (or the saturation vapor pressure represented by the broken curve in FIG. 3) and the saturation vapor pressure of the used fuel (or the saturation vapor pressure represented by the solid curve in FIG. 3) at the fuel temperature temp0 at the time when the saturation vapor pressure is detected (i.e. the temperature measured by the fuel temperature sensor 20 at the time when the vapor is detected), the difference ΔP1 at temperatures lower than the measured temperature temp0 is smaller than the reference difference ΔP0 and the difference Δp2 at temperatures higher than the measured temperature temp 0 is larger than the reference difference ΔP0.

Figure 4:
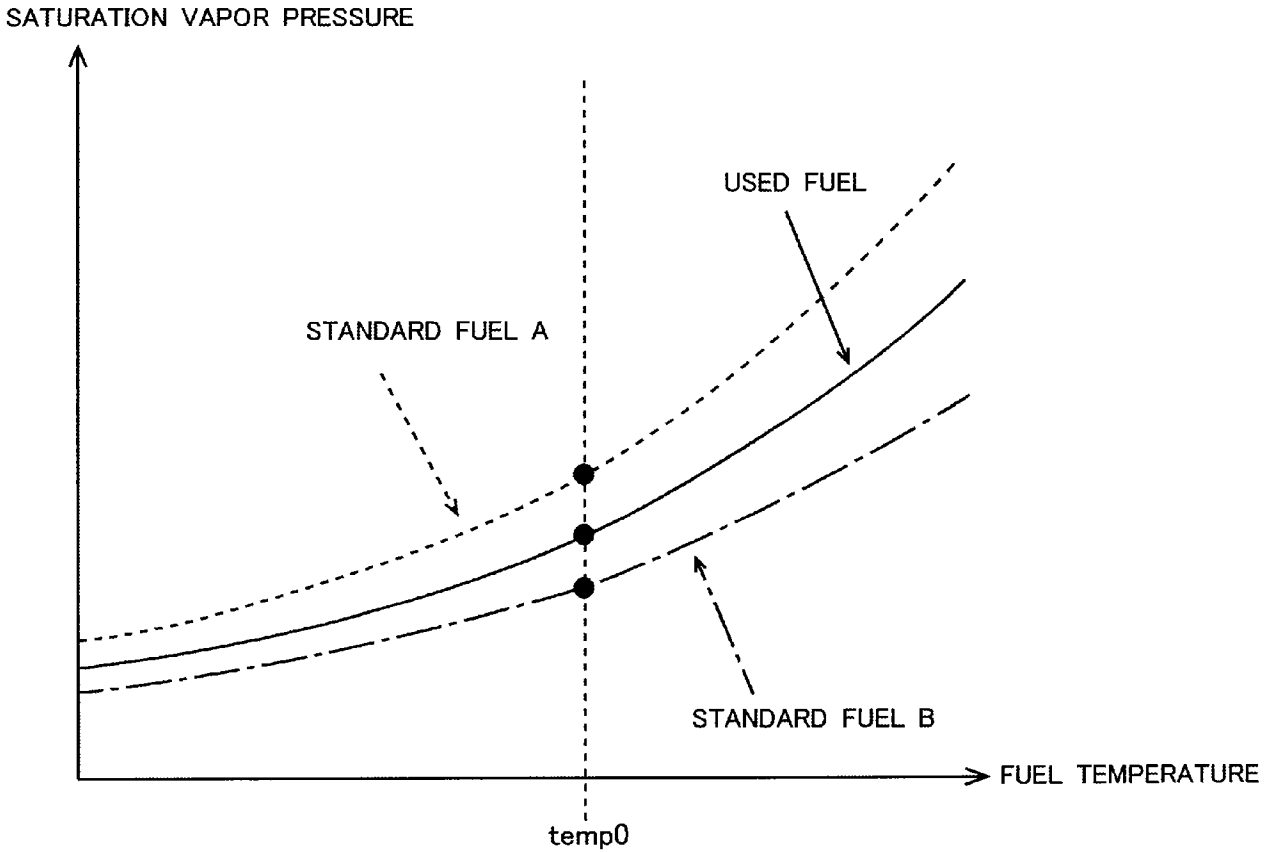
FIG. 4 illustrates another method of estimating a saturation vapor pressure curve of the used fuel.

In another method of estimating the saturation vapor pressure curve that may be adopted, as shown in FIG. 4, saturation vapor pressure curves of a plurality of standard fuels having difference properties are stored in advance in the ECU 15 and a curve is interpolated between the saturation vapor pressure curve of a standard fuel A (e.g. the saturation vapor pressure curve represented by the broken curve in FIG. 4) having a saturation vapor pressure higher than that of the used fuel at the measured temperature temp0 and the saturation vapor pressure curve of a standard fuel B (e.g. the saturation vapor pressure curve represented by the alternate long and short dashed curve in FIG. 4) having a saturation vapor pressure lower than that of the used fuel at the measured temperature temp0.

If the saturation vapor pressure curve of the used fuel has been obtained in this way, the saturation vapor pressure at the fuel temperature at the present time can be obtained from this saturation vapor pressure curve and the measurement value of the fuel temperature sensor 20. Then, the target feed pressure is set to be a value obtained by adding a margin to the saturation vapor pressure. Thus, the target feed pressure can be set as low as possible within the range in which vapor is not generated.

Figure 5:
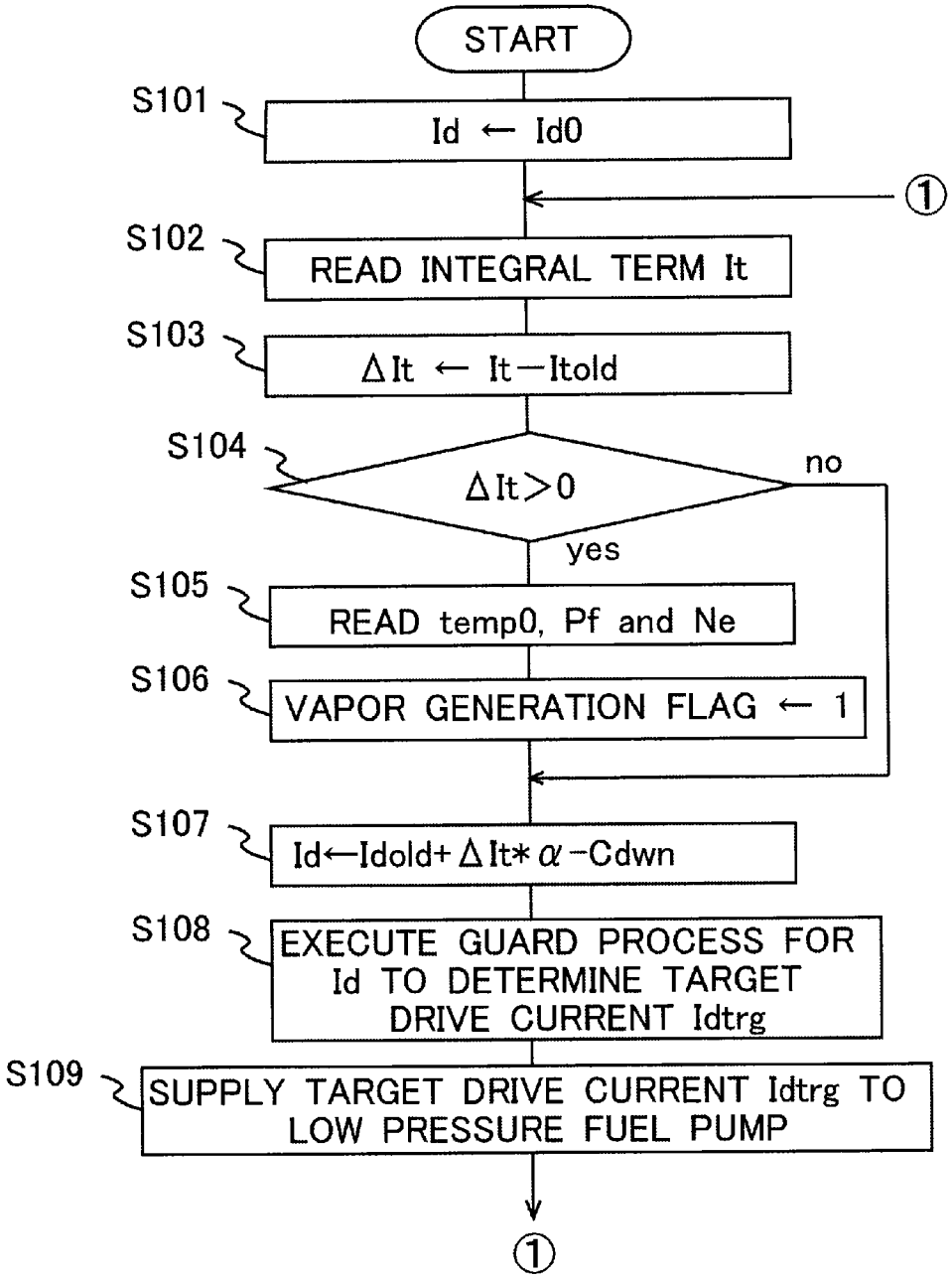
FIG. 5 is a flow chart of a lowering process routine.
Figure 6:
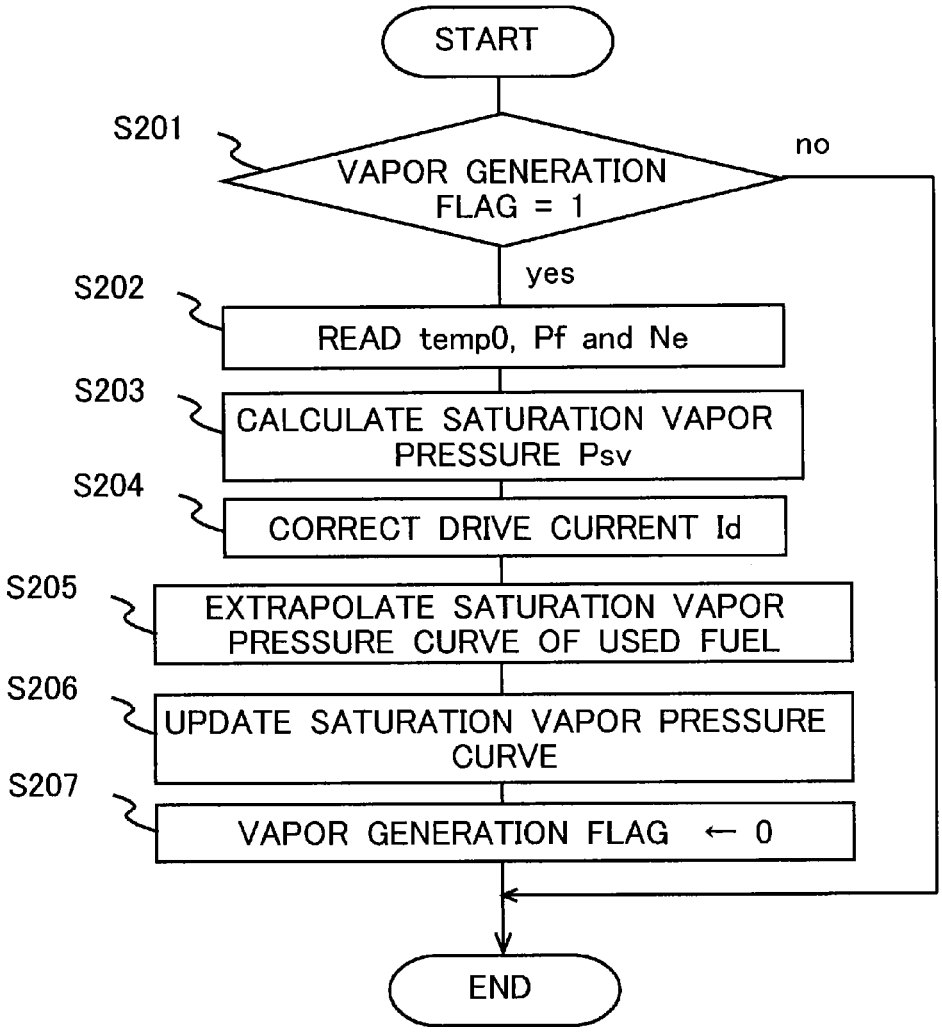
FIG. 6 is a flow chart of a target feed pressure correction process routine in a first embodiment.

In the following, a process of correcting the target feed pressure in this embodiment will be described with reference to FIGS. 5 and 6. FIG. 5 is a flow chart of a lowering process routine in this embodiment. The lowering process routine is stored in the ROM of the ECU 15 in advance, and the execution of this routine is triggered by the start-up of the internal combustion engine (e.g. the turning on of an ignition switch). FIG. 6 is a flow chart of a target feed pressure correction process routine in this embodiment. The target feed pressure correction process routine is stored in the ECU 15 in advance and executed by the ECU 15 as an interrupt service routine at the time when the generation of vapor is detected in the lowering process routine.

First, in the lowering process routine shown in FIG. 5, the ECU 15 sets the drive current Id for the low pressure fuel pump 4 to an initial value Id0 firstly in step 101. The initial value Id0 is set in such a way that the feed pressure of the low temperature fuel pump 4 becomes equal to the value obtained by adding a margin to the saturation vapor pressure of the standard fuel (i.e. equal to the target feed pressure). The initial value Id0 may be determined from the temperature measured by the fuel temperature sensor 20 and the saturation vapor pressure curve of the standard fuel.

In step S102, the ECU 15 reads the value of the integral term It used in the calculation of the duty cycle of the high pressure fuel pump 6. Then, the ECU 15 proceeds to step S103, where it calculates the difference ΔIt (=It−Itold) by subtracting the previous integral term Itold from the integral term It read in the above step S102.

In step S104, the ECU 15 determines whether the difference ΔIt calculated in step S103 is a positive value or not. If the determination in step S104 is affirmative (ΔIt>0), vapor should have started to be generated in the low pressure fuel passage 5. Then, the ECU 15 proceeds to step S105, where it reads the temperature temp0 measured by the fuel temperature sensor 20, the pressure Pf measured by the feed pressure sensor 21 and the engine speed Ne at the time of the generation of vapor and stores these values in, for example, a backup RAM. Then, the ECU 15 proceeds to step S106, where it sets the value of a vapor generation flag to "1". The vapor generation flag is a memory area set in advance in, for example, the backup RAM. When vapor is generated, the value "1" is stored in the vapor generation flag, and the vapor generation flag is reset to "0" when the saturation vapor pressure of the used fuel is determined in the target feed pressure correction routine, which will be described later. The execution of the process of steps S104 to S106 by the ECU 15 embodies the detection unit according to the present invention.

After executing the process of step S106, the ECU 15 proceeds to step S107. If the determination in step S104 is negative (ΔIt≤0), the ECU 15 skips the process of S105 and S106 and proceeds to step S107.

In step S107, the ECU 15 calculates the drive current Id for the low pressure fuel pump 4 using the difference ΔIt calculated in step S103 and a lowering factor Cdwn. Here, the ECU 15 calculates the drive current Id according to the following equation:

$$Id=Id\text{old}+\Delta It*\alpha-Cdwn$$

In the above equation, α is a moderating coefficient, which is determined in advance by an adaptation process utilizing an experiment etc.

If the value of the difference ΔIt is positive (namely, if the integral term It exhibits an increasing tendency), the drive current Id will increase. In this case, the discharge pressure (or feed pressure) Pl of the low pressure pump 4 will increase. On the other hand, if the value of the difference ΔIt is zero (namely, if the integral term It is constant), or if the value of the integral term It is negative (namely, if the integral term It exhibits a decreasing tendency), the drive current Id will decrease. In this case, the discharge pressure (or feed pressure) Pl of the low pressure fuel pump 4 will decrease.

In step S108, the ECU 15 executes a guard process for the drive current Id obtained in the above step S107. Specifically, the ECU 15 determines whether or not the drive current Id obtained in the above step S107 is larger than a lower limit value and smaller than an upper limit value. If the drive current Id obtained in the above step S107 is larger than the lower limit value and smaller than the upper limit value, the ECU 15 sets the target drive current Idtrg to the drive current Id. If the drive current Id exceeds the upper limit value, the ECU 15 sets the target drive current Idtrg to a value equal to the upper limit value. If the drive current Id is smaller than the lower limit value, the ECU 15 sets the target drive current Idtrg to a value equal to the lower limit value.

In step S109, the ECU 15 supplies the target drive current Idtrg set in the above step S108 to the low pressure fuel pump 4 to thereby drive the low pressure pump 4. The ECU 15 executes the process of step S102 and the subsequent steps repeatedly after executing the process of step S109.

As described above, with the execution of the lowering process routine shown in FIG. 5 by the ECU 15, the discharge pressure of the lower pressure fuel pump 4 is lowered when the integral term It is constant or exhibits a decreasing tendency (namely, when the value of the difference ΔIt is zero or negative) and raised when the integral term It exhibits an increasing tendency (namely, when the value of the difference ΔIt is positive). Consequently, the lowering of the feed pressure P1 can be stopped before a large amount of vapor is generated in the low pressure fuel passage 5 (namely at the time when vapor starts to be generated).

Therefore, the feed pressure Pl can be made as low as possible without causing a large fall in the fuel pressure Ph or a deviation of the air-fuel ratio. Moreover, when the lowering of the feed pressure Pl is stopped, the larger the difference ΔIt is, the higher the feed pressure Pl is made. Therefore, a suction failure and a discharge failure in the high pressure fuel pump 6 can be avoided more reliably.

Next, in the target feed pressure correction process routine shown in FIG. 6, firstly in step S201, the ECU 15 determines whether or not the value of the vapor generation flag is "1". If the determination in step S201 is negative, the ECU 15 terminates the execution of this routine. On the other hand, if the determination in step S201 is affirmative, the ECU 15 proceeds to step S202.

In step S202, the ECU 15 reads from the backup RAM the fuel temperature Temp0, the feed pressure pf and the engine speed Ne measured at the time when vapor is generated. Then, the ECU 15 proceeds to step S203, where it calculates the saturation vapor pressure Psv of the used fuel at fuel temperature temp0 using as parameters the feed pressure pf and the engine speed Ne read in the above step S202. For example, the ECU 15 may calculate the saturation vapor pressure Psv by multiplying the feed pressure Pf by a correction coefficient A. The correction coefficient A is a number not higher than 1, which is made smaller when the engine speed Ne is high than when the engine speed Ne is low. The execution of the process of step S202 by the ECU 15 embodies the calculation unit according to the present invention.

In step S204, the ECU 15 corrects the drive current Id of the low pressure fuel pump 4 based on the saturation vapor pressure Psv obtained in the above step S203. For example, the ECU 15 corrects the drive current Id in such a way that the feed pressure of the low pressure fuel pump 4 becomes equal to the value obtained by adding a margin to the saturation vapor pressure Psv obtained in the above step S203. At the time when the engine speed is high, the fuel pressure in the low pressure fuel passage 5 is lower than the feed pressure of the low pressure fuel pump 4. Therefore, it is desirable that the drive current Id be corrected in relation to the engine speed. For example, the drive current Id may be corrected in such a way that it is made larger when the engine speed is high than when the engine speed is low. Correction of the drive current Id according to the above method enables to prevent the generation of vapor even in cases where the fuel pressure in the low pressure passage 5 becomes lower than the feed pressure of the low pressure fuel pump 4.

In step S205, the ECU 15 estimates (determines or extrapolates) a saturation vapor pressure curve of the used fuel using the fuel temperature temp0 read in the above step S202 and the saturation vapor pressure Psv calculated in the above step 203. In this process, the ECU 15 may determine the saturation vapor pressure curve of the used fuel according to the method described above with reference to FIGS. 3 and 4.

In step S206, the ECU 15 changes (or updates) the saturation vapor pressure curve to be used to set the target feed pressure (in other words, the saturation vapor pressure curve to be used to set the drive current Id of the low pressure fuel pump 4) to the saturation vapor pressure curve determined in the above step S205. Then, the ECU 15 proceeds to step S207, where it resets the value of the vapor generation flag to "0".

The execution of the process of steps S203 to S205 by the ECU 15 embodies the setting unit according to the present invention.

As described above, by executing the target feed pressure correction routine by the ECU 15, the saturation vapor pressure Psv of the used fuel can be determined, and the target feed pressure (or drive current Id) of the low pressure fuel pump 4 can be corrected based on the saturation vapor pressure Psv thus determined. Consequently, the target feed pressure can be set as low as possible within the range in which vapor is not generated.

When the internal combustion engine is in a cold state before warm-up, the fuel injection quantity may be corrected in relation to the saturation vapor pressure Psv of the used fuel. When the internal combustion engine is in a cold state, an increasing correction for increasing the fuel injection quantity is performed in some cases. There is a possibility that the increasing correction amount in such cases may be set to be relatively large so that the ignitability and combustion stability is not deteriorated even if a characteristically relatively heavy fuel (which will be hereinafter referred to as the "standard heavy fuel") is used. However, if the actually used fuel is light, the correction amount will be too large, leading to an unnecessary increase in the fuel consumption. In view of this, the ECU 15 may be adapted to decrease the increasing correction amount if the saturation vapor pressure Psv of the used fuel is higher than the saturation vapor pressure of the standard heavy fuel at the time when the saturation vapor pressure Psv of the used fuel is obtained in the target feed pressure correction process routine. This enables a reduction in the fuel consumption without deteriorating the ignitability of fuel or the combustion stability.

Moreover, there is a possibility that light oil may mistakenly be fed as fuel to an internal combustion engine whose standard fuel is gasoline or gasoline may mistakenly be fed as fuel to an internal combustion engine whose standard fuel is light oil. For instance, in the case where light oil is mistakenly fed as fuel to an internal combustion engine whose standard fuel is gasoline, knocking might occur due to a decrease in the octane number or miss fire and deterioration in the combustion stability might be caused due to a decrease in the volatility. Therefore, if light oil is mistakenly fed in place of gasoline, it is necessary to execute a process for preventing knocking or promoting the evaporation of fuel. (This process will be hereinafter referred to as the "first compensation process").

On the other hand, if gasoline is mistakenly fed as fuel to an internal combustion engine whose standard fuel is light oil, seizing of the fuel pump (high pressure fuel pump 6, especially) might be caused due to a decrease in the lubricity of fuel. Therefore, if gasoline is mistakenly fed in place of light oil, it is necessary to execute a process of restricting the output of the internal combustion engine. (This process will be hereinafter referred to as the "second compensation process").

Since the light oil is heavier than gasoline, in the case where light oil is mistakenly fed as fuel to an internal combustion engine whose standard fuel is gasoline, the saturation vapor pressure Psv of the used fuel will be much lower than the saturation vapor pressure Psv0 of the standard fuel. On the other hand, in the case where gasoline is mistakenly fed as fuel to an internal combustion engine whose standard fuel is light oil, the saturation vapor pressure Psv of the used fuel will be much higher than the saturation vapor pressure Psv0 of the standard fuel.

Figure 7:
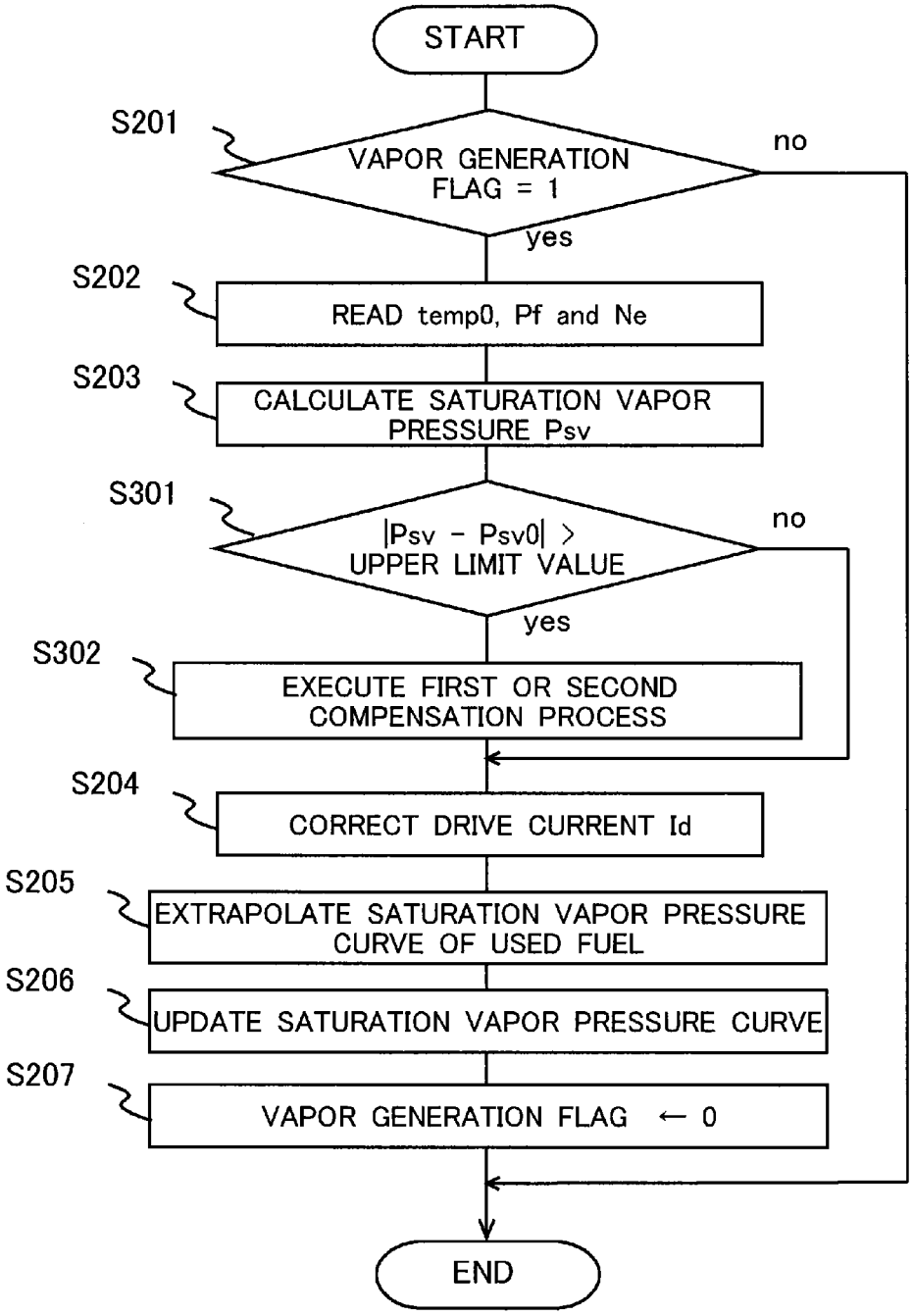
FIG. 7 is a flow chart of another example of the target feed pressure correction process routine in the first embodiment.

In view of the above, the ECU 15 may be adapted to execute the first or second compensation process on condition that the difference between the saturation vapor pressure Psv of the used fuel and the saturation vapor pressure Psv0 of the standard fuel exceeds an upper limit value. Specifically, the ECU 15 may be adapted to calculate (S301) the absolute value of the difference between the saturation vapor pressure Psv of the used fuel and the saturation vapor pressure Psv0 of the standard fuel at the time when the saturation vapor pressure Psv is calculated in step S203 of the target feed pressure correction process routine and to execute (S302) the first or second compensation process if the absolute value of the difference is larger than the upper limit value. FIG. 7 is a flow chart of another example of the target feed pressure correction process routine, where the processes same as those in FIG. 6 described above are denoted by the same symbols. The upper limit value mentioned here is equal to the difference between the saturation vapor pressure of gasoline and the saturation vapor pressure of light oil or a value obtained by subtracting a margin from the above difference.

As the first compensation process, for example, a process of retarding the ignition timing, a process of increasing the internal EGR gas, or a process of raising the fuel injection pressure (i.e. a process of raising the discharge pressure of the high pressure fuel pump 6) may be executed. In the case where the ignition timing is retarded, the generation of knocking can be suppressed. In the case where the internal EGR gas is increased, the temperature in the cylinder will rise. Consequently, the evaporation of fuel can be promoted. In the case where the fuel injection pressure is raised, fuel will be atomized. Consequently, the evaporation of fuel can be promoted. Therefore, if the first compensation process is executed in cases where light oil is mistakenly fed in place of gasoline, the internal combustion engine can operate with knocking prevented from occurring. Consequently, it is possible to drive the vehicle by emergency driving.

As the second compensation process, a process of restricting the torque generated by the internal combustion engine to a specific torque or below and a process of restricting the speed (engine speed) of the internal combustion engine to a specific speed or below may be executed. If the torque generated by the internal combustion engine and the engine speed are restricted, the load on the fuel pump will be decreased. Therefore, if the second compensation process is executed in cases where gasoline is mistakenly fed in place of light oil, the internal combustion engine can operate the fuel pump prevented from seizing due to a decrease in the lubricity of fuel. Consequently, it is possible to drive the vehicle by emergency driving.

There may be cases where a very light gasoline is fed as fuel to an internal combustion engine whose standard fuel is gasoline. In such cases, the amount of vaporized fuel generated in the fuel tank will increase. The vaporized fuel generated in the fuel tank is once absorbed by a canister or the like and thereafter supplied to the intake system. However, during the time when the internal combustion engine is idling, the quantity of fuel needed in combustion is small, and consequently, there is a possibility that a large amount of vaporized fuel generated in the fuel tank may be emitted to the atmosphere without supplied to the intake system.

Figure 8:
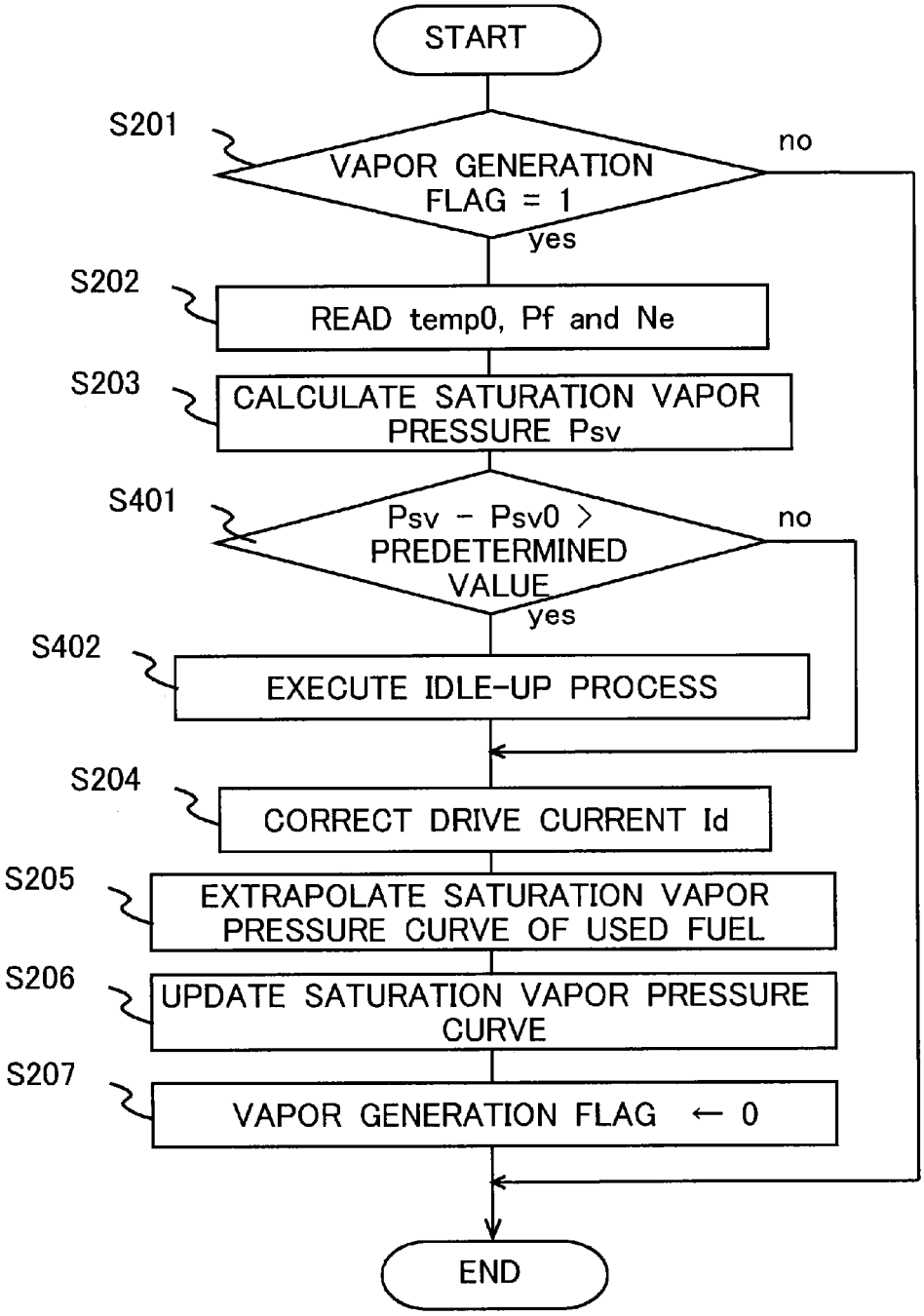
FIG. 8 is a flow chart of still another example of the target feed pressure correction process routine in the first embodiment.

In view of the above, the ECU 15 may be adapted to execute an idle-up process for increasing the idle speed of the internal combustion engine when the saturation vapor pressure Psv of the used fuel is higher than the saturation vapor pressure Psv0 of the standard fuel by a margin equal to or larger than a predetermined value. Specifically, as shown in FIG. 8, the ECU 15 may be adapted to subtract (S401) the saturation vapor pressure Psv0 of the standard fuel from the saturation vapor pressure Psv of the used fuel at the time when the saturation vapor pressure Psv is calculated in step S203 of the target feed pressure correction process routine and to execute (S402) the idle-up process if the result of the subtraction (=Psv−Psv0) is larger than a predetermined value (>0). FIG. 8 is a flow chart of another example of the target feed pressure correction process routine, where the processes same as those in FIG. 6 described above are denoted by the same symbols. The predetermined value mentioned here is a value determined based on the difference between the saturation vapor pressure Psv0 of the standard fuel and a saturation vapor pressure of fuel with which it is considered that the amount of vaporized fuel generated in the fuel tank will become larger than the amount of vaporized fuel that is allowed to be supplied to the intake system while the internal combustion engine is idling. For example, the predetermined value may be a value obtained by subtracting a margin from the difference.

By executing the idle-up process in this way, it is possible to prevent failures such as emission of vaporized fuel to the atmosphere from occurring in cases where a fuel that is much lighter than the standard fuel is fed. In the idle-up process, the larger the difference between the saturation vapor pressure Psv of the used fuel and the saturation vapor pressure Psv0 of the standard fuel is, the larger the amount of increase in the idle speed may be made. This enables more reliable prevention of emission of vaporized fuel to the atmosphere.

Embodiment 2

Next, a second embodiment of the present invention will be described with reference to FIGS. 9 to 13. Here, the features that are different from those in the first embodiment will be described, and like features will not be described.

The difference between the above-described first embodiment and this embodiment resides in the timing of determination of the saturation vapor pressure Psv of the used fuel. While in the above-described first embodiment a case in which the determination of the saturation vapor pressure Psv of the used fuel is triggered by the generation of vapor during the execution of the lowering process has been described, in this embodiment a case in which the determination of the saturation vapor pressure Psv of the used fuel is triggered by fueling will be described.

Figure 9:
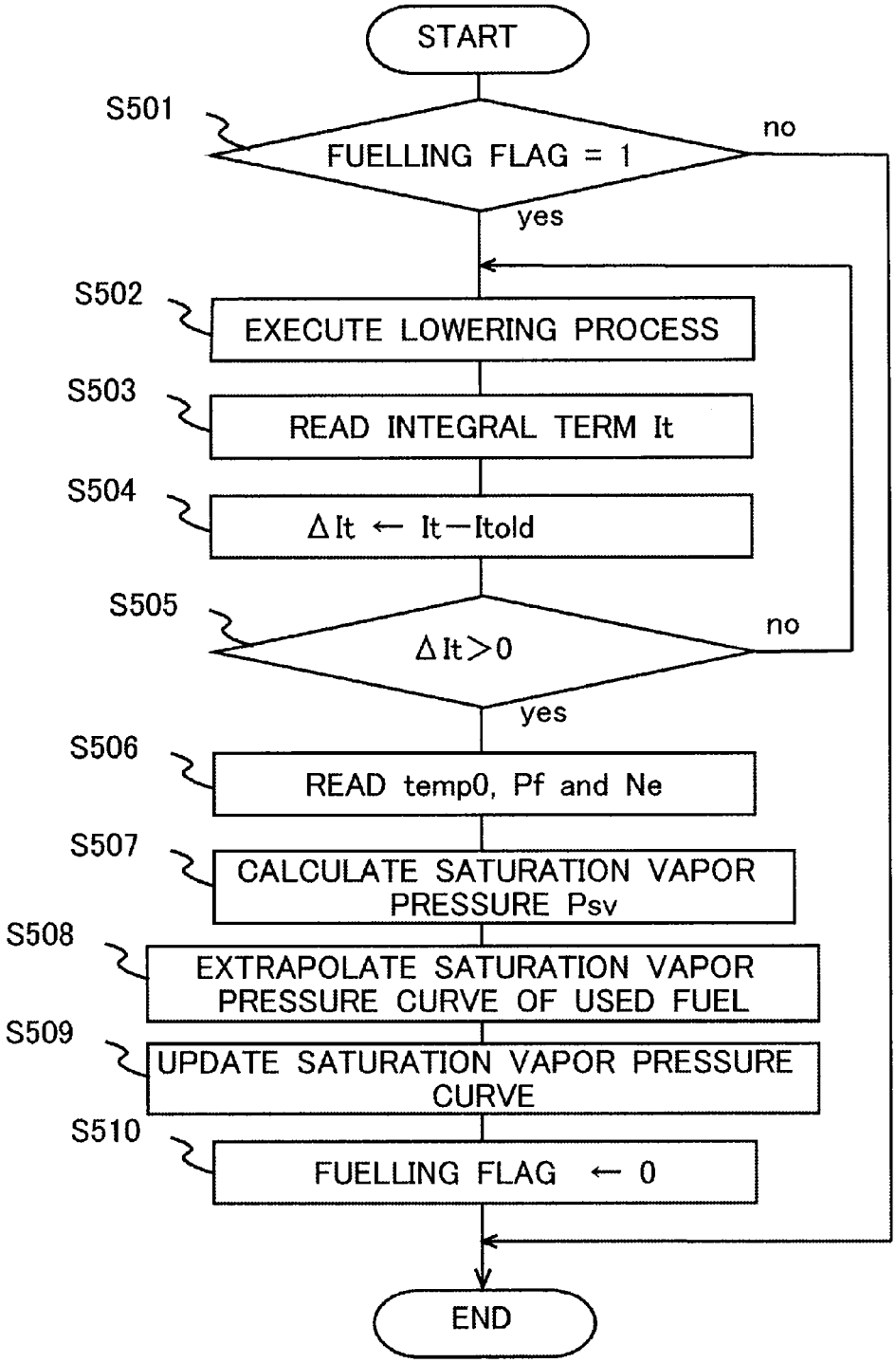
FIG. 9 is a flow chart of a saturation vapor pressure determination process routine in a second embodiment.

FIG. 9 is a flow chart of a saturation vapor pressure determination routine in this embodiment. The saturation vapor pressure determination routine is stored in advance in, for example, a ROM of the ECU 15, and the execution of this routine is triggered by fueling.

In the saturation vapor pressure determination routine in FIG. 9, firstly in step S501, the EGC 15 determines whether or not the value of the fueling flag is "1". The fueling flag is a memory area set in, for example, a backup RAM of the ECU 15. When fuel is fed, the fuelling flag is set to "1", and when the saturation vapor pressure Psv of the used fuel is determined, the fueling flag is reset to "0". The method of determining whether fuel is fed or not may be, for example, to determine that fuel is fed when a sensor for detecting opening and closing of a fill opening detects opening and closing of the fill opening or to determined that fuel is fed when a sensor for sensing the amount of fuel in the fuel tank detects an increase in the fuel amount.

If the determination in step S501 is negative (namely fuelling flag=0), the ECU 15 once terminates the execution of this routine. On the other hand, if the determination in step S501 is affirmative (namely fuelling flag=1), the ECU 15 proceeds to step S502. In step S502, the ECU 15 lowers the target feed pressure (or drive current Id) of the low pressure fuel pump 4 stepwise in a similar manner as the lowering process described in the above-described first embodiment.

In step S503, the ECU 15 reads the value of the integral term It used in calculating the duty cycle of the high pressure fuel pump 6. Then, the ECU 15 proceeds to step S504, where it calculates a difference ΔIt (=It−Itold) by subtracting the previous integral term Itold from the integral term It read in the above step S503.

In step S505, the ECU 15 determines whether or not the difference ΔIt calculated in the above step S504 is a positive value. If the determination in step S505 is negative (ΔIt≤0), vapor has not been generated in the low pressure fuel passage 5. Then, the ECU 15 returns to step S502. If the determination in step S505 is affirmative (ΔIt>0), vapor has started to be generated in the low pressure fuel passage 5. Then, the ECU 15 proceeds to step S506.

In step S506, the ECU 15 reads the fuel temperature (i.e. the temperature measured by the fuel temperature sensor 20) temp0, the feed pressure (i.e. the pressure measured by the feed pressure sensor 21) Pf and the engine speed Ne at the time of the generation of vapor. Then, the ECU 15 proceeds to step S507, where it calculates the saturation vapor pressure Psv of the used fuel at fuel temperature temp0 using as parameters the feed pressure Pf and the engine speed Ne read in the above step S506.

In step S508, the ECU 15 estimates (or determines) a saturation vapor pressure curve of the used fuel using the fuel temperature temp0 read in the above step S506 and the saturation vapor pressure Psv calculated in the above step S507. In step S509, the ECU 15 changes (or updates) the saturation vapor pressure curve to be used in setting the target feed pressure to the saturation vapor pressure curve determined in the above step S507. Then, the ECU 15 proceeds to step S510, where it resets the value of the fuelling flag to "0".

According to the above-described embodiment, a change in a property (or saturation vapor pressure) of fuel caused by fuelling can be detected promptly.

There is a possibility that light components contained in fuel may evaporate with the lapse of time. If light components in fuel evaporate, a property (or saturation vapor pressure) of fuel might change (or decrease). In view of this, the ECU 15 may be adapted to execute a process of determining the saturation vapor pressure at the time when the amount of vaporized fuel reaches or becomes larger than a predetermined specific amount.

Figure 10:
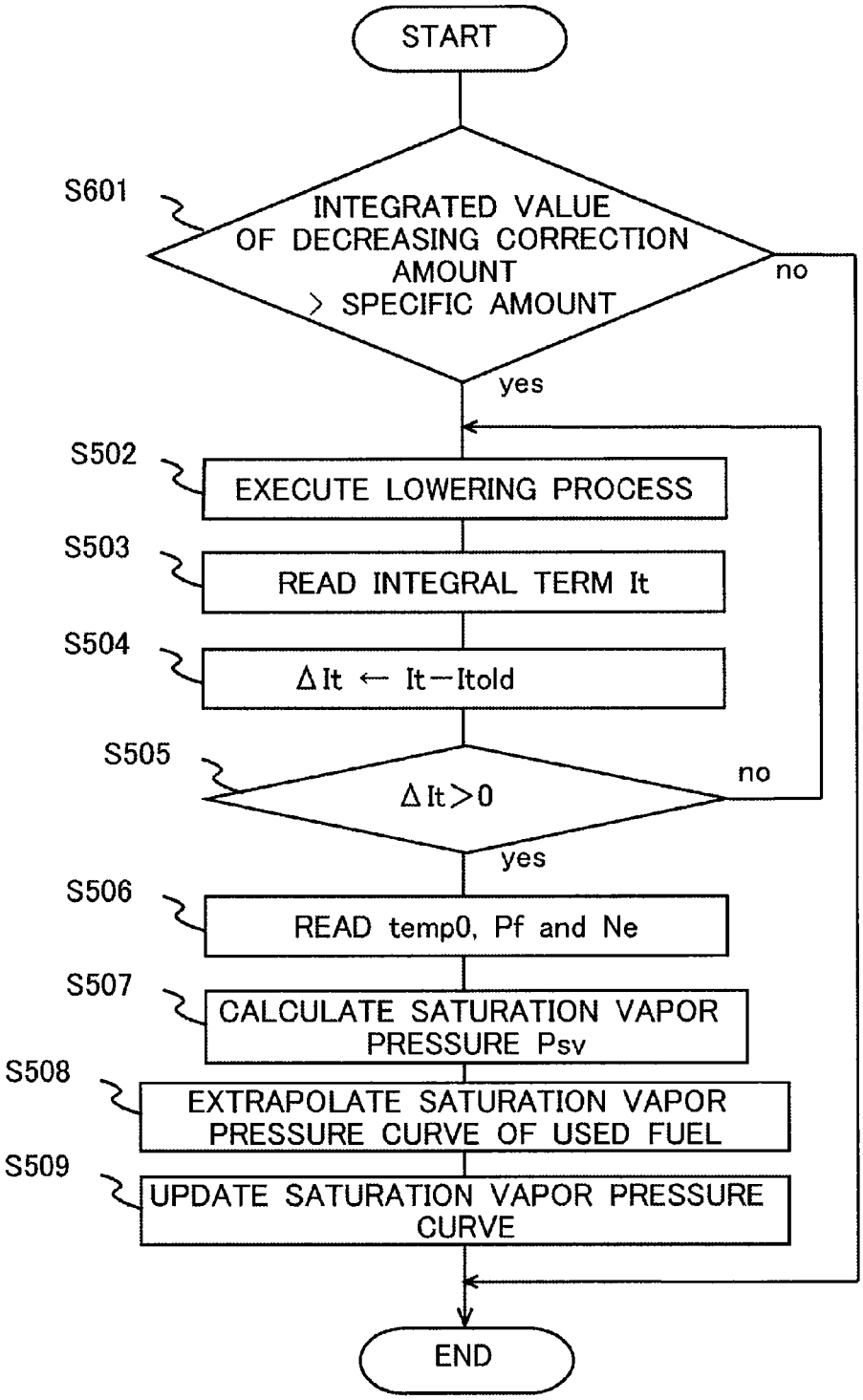
FIG. 10 is a flow chart of another example of the saturation vapor pressure determination process routine in the second embodiment.

For example, in the case of an internal combustion engine equipped with a purge apparatus that supplies vaporized fuel generated in the fuel tank to the intake system, a decreasing correction process of decreasing the fuel injection quantity according to the quantity of vaporized fuel supplied by the purge apparatus. Therefore, the process of determining the saturation vapor pressure may be executed on condition that the integrated value of the correction amount in the decreasing correction process reaches a specific amount. Specifically, as shown in FIG. 10, the ECU 15 may be adapted to determine (S601) whether or not the integrated value of the correction amount in the decreasing correction process is larger than the specific amount and to execute the process same as the above-described process of steps S502 to S509 in FIG. 9 on condition that the determination in the above step S601 is affirmative. FIG. 10 is a flow chart of another example of the saturation vapor pressure determination process routine, where the processes same as those in FIG. 9 described above are denoted by the same symbols. Even in cases where a property (or saturation vapor pressure) has changed due to the evaporation of light components in fuel, the determination of the saturation vapor pressure of the used fuel by the above method enables quick determination of the saturation vapor pressure after the change.

Figure 11:
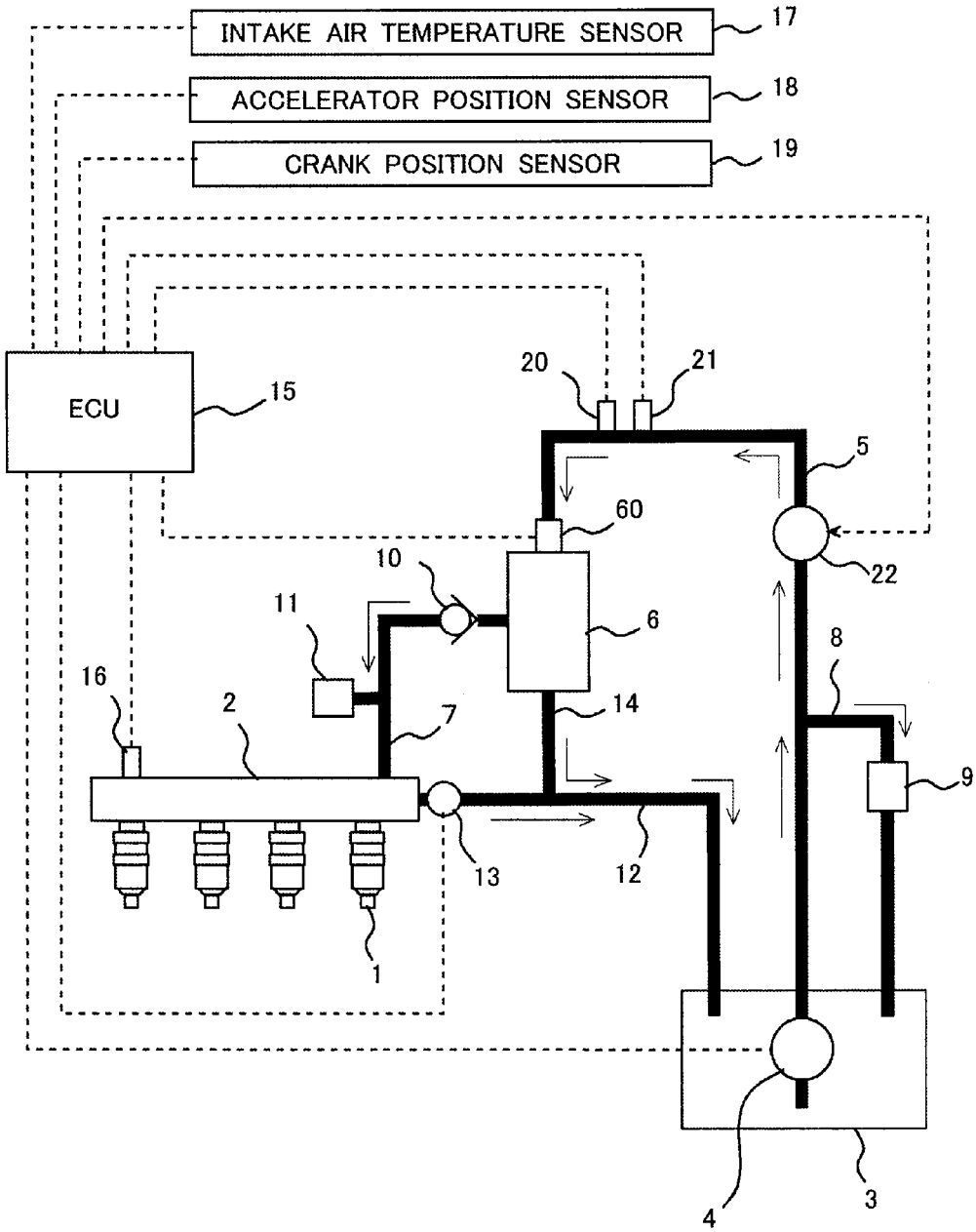
FIG. 11 is a diagram showing another configuration of the fuel injection system of an internal combustion engine according to the second embodiment.

If the saturation vapor pressure determination process is executed at a time when the fuel temperature is low, there is a possibility that vapor may not be generated. In addition, the difference in the saturation vapor pressure resulting from the difference in fuel properties tends to be smaller when the fuel temperature is low than when the fuel temperature is high. In view of this, a heating apparatus 22 that heats the fuel flowing into the high pressure fuel pump 6 may be provided as shown in FIG. 11, and the heating apparatus 22 may be adapted to operate when the saturation vapor pressure determination process is executed. In this case, the heating apparatus 22 should be provided in the low pressure fuel passage 5 upstream of the fuel temperature sensor 20 and the feed pressure sensor 21.

Figure 12:
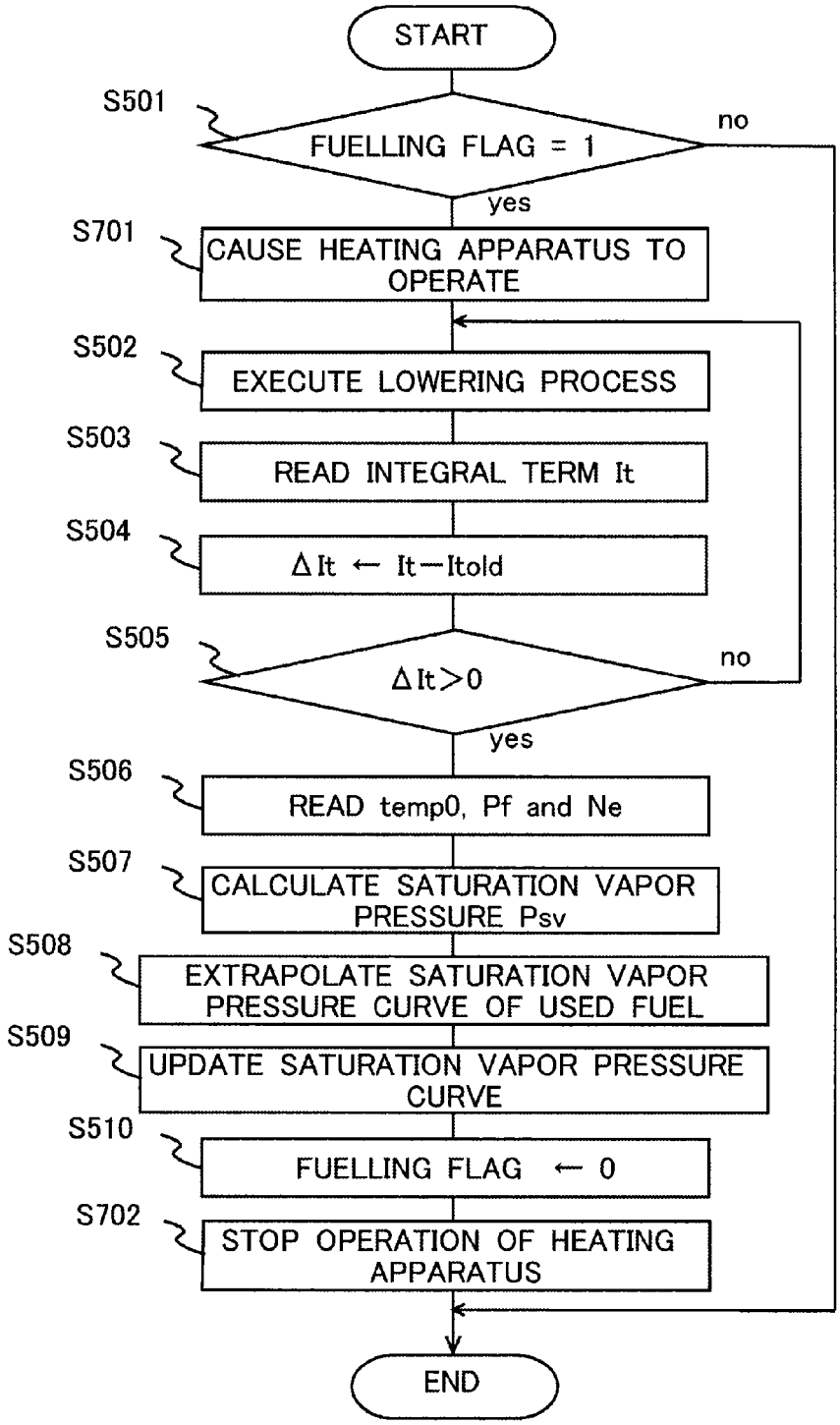
FIG. 12 is a flow chart of still another example of the saturation vapor pressure determination process routine in the second embodiment.

In the case where the execution of the saturation vapor pressure determination process is triggered by fueling, the ECU 15 may be adapted, as shown in FIG. 12, to execute the process of steps S502 to S510 after causing the heating apparatus 22 to operate (S701) and to stop the operation of the heating apparatus 22 after the execution of the process of step S510 (S702). FIG. 12 is a flow chart of another example of the saturation vapor pressure determination routine, where the processes same as those in FIG. 9 described above are denoted by the same symbols.

Figure 13:
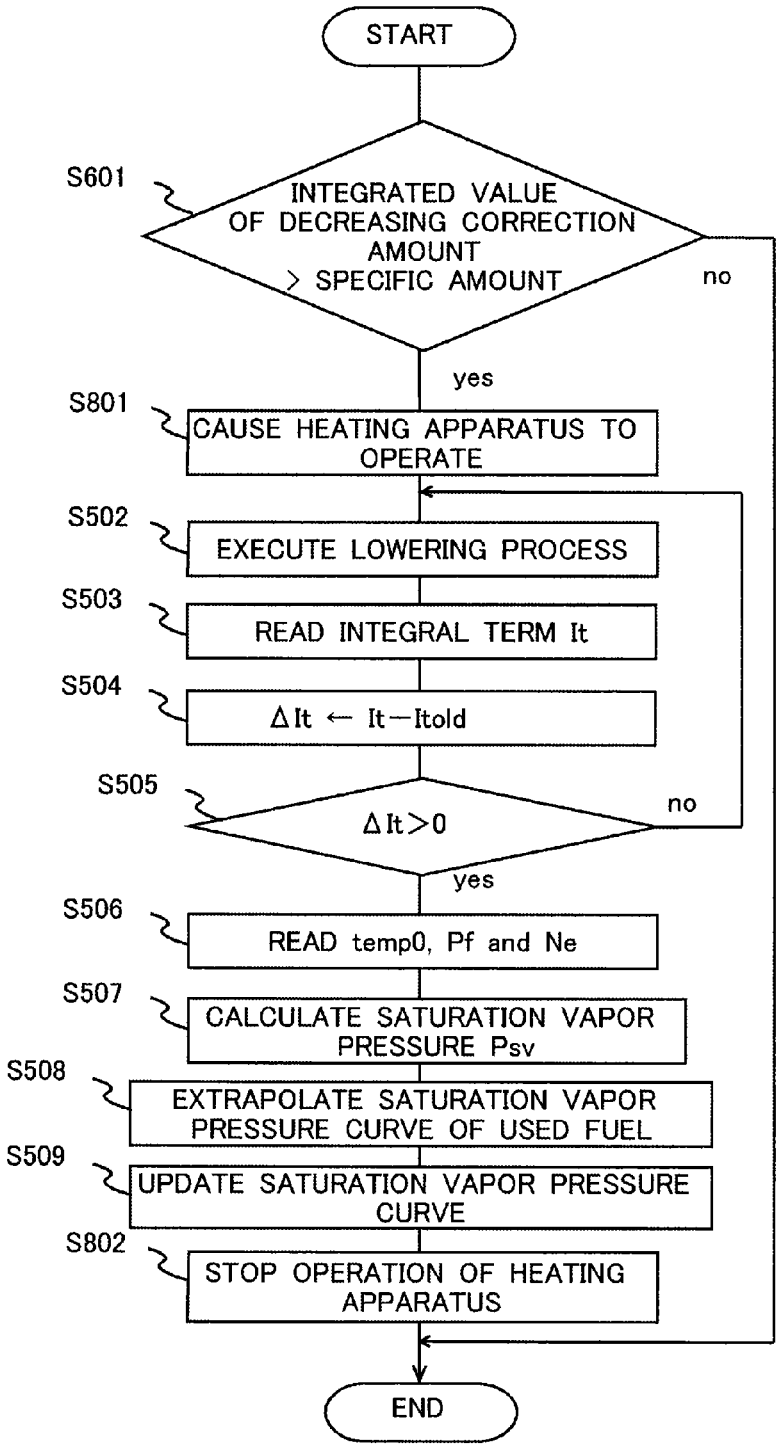
FIG. 13 is a flow chart of still another example of the saturation vapor pressure determination process routine in the second embodiment.

In the case where the execution of the saturation vapor pressure determination process is triggered when the integrated value of the correction amount in the above-described decreasing correction process reaches a specific amount, the ECU 15 may be adapted, as shown in FIG. 13, to execute the process of steps S502 to S509 after causing the heating apparatus 22 to operate (S801) and to stop the operation of the heating apparatus 22 after the execution of the process of step S509 (S802). FIG. 13 is a flow chart of another example of the saturation vapor pressure determination routine, where the processes same as those in FIG. 10 described above are denoted by the same symbols.

Executing the saturation vapor pressure determination process while heating fuel facilitates the generation of vapor and makes the difference in the saturation vapor pressure resulting from the difference in fuel properties large. Consequently, the chances of determination of the saturation vapor pressure increase, and it is possible to determine the difference in the saturation vapor pressure resulting from the difference in fuel properties more accurately.

REFERENCE SIGNS LIST

1: fuel injection valve
2: delivery pipe
3: fuel tank
4: low pressure fuel pump
5: low pressure fuel passage
6: high pressure fuel pump
7: high pressure fuel passage
8: branch passage
9: pressure regulator
10: check valve
11: pulsation damper
12: return passage
13: relief valve
14: communication passage
15: ECU
16: fuel pressure sensor
17: intake air temperature sensor
18: accelerator position sensor
19: crank position sensor
20: fuel temperature sensor
21: feed pressure sensor
22: heating apparatus
60: inlet valve

The invention claimed is:

1. A fuel injection control system for an internal combustion engine in which fuel discharged from a low pressure fuel pump is supplied to a fuel injection valve with its pressure boosted by a high pressure fuel pump, comprising:

a processing unit that executes a lowering process of lowering the discharge pressure of the low pressure fuel pump;

a first pressure sensor that measures the discharge pressure of the low pressure fuel pump;

a temperature sensor that measures the temperature of fuel discharged from the low pressure fuel pump;

a second pressure sensor that measures the discharge pressure of the high pressure fuel pump;

a control unit that performs proportional-integral control of the duty cycle of the high pressure fuel pump based on the difference between a target discharge pressure of the high pressure fuel pump and a measurement value of the second pressure sensor;

a detection unit that detects generation of vapor based on a tendency of change in an integral term used in the proportional-integral control during the execution of the lowering process; and a calculation unit that calculates the saturation vapor pressure of fuel from a measurement value of the first pressure sensor and a measurement value of the temperature sensor at the time when the detection unit detects generation of vapor.

2. A fuel injection control system for an internal combustion engine according to claim 1, wherein the calculation unit corrects the measurement value of the first pressure sensor based on the engine speed and calculates the saturation vapor pressure of fuel from the thus-corrected measurement value and the measurement value of the temperature sensor.

3. A fuel injection control system for an internal combustion engine according to claim 1 further comprising a setting unit that sets a target discharge pressure of the low pressure fuel pump in relation to the saturation vapor pressure calculated by the calculation unit.

4. A fuel injection control system for an internal combustion engine according to claim 3, wherein the setting unit estimates a saturation vapor pressure curve of an actually used fuel based on the saturation vapor pressure of a presupposed standard fuel and the saturation vapor pressure calculated by the calculation unit and sets the target discharge pressure of the low pressure fuel pump based on the saturation vapor pressure curve thus estimated.

5. A fuel injection control system for an internal combustion engine according to claim 1 further comprising an increasing correction unit that performs an increasing correction of the fuel injection quantity when the internal combustion engine is in a cold state, wherein the increasing correction unit makes a correction amount smaller when the saturation vapor pressure calculated by the calculation unit is high than when the saturation vapor pressure calculated by the calculation unit is low.

6. A fuel injection control system for an internal combustion engine according to claim 1, wherein the detection unit executes the process of detecting generation of vapor when fuelling is performed, and the calculation unit calculates the saturation vapor pressure of fuel from the measurement value of the first pressure sensor and the measurement value of the temperature sensor at the time when generation of vapor is detected by the detection unit.

7. A fuel injection control system for an internal combustion engine according to claim 1 further comprising:

a purge apparatus that supplies vaporized fuel generated in a fuel tank to an intake system of the internal combustion engine; and a purge correction unit that performs a decreasing correction of fuel injection quantity according to the amount of vaporized fuel supplied by the purge apparatus, wherein the detection unit executes a process of detecting generation of vapor when an integrated value of a correction amount in the purge correction unit reaches a specific amount, and the calculation unit calculates the saturation vapor pressure of fuel from the measurement value of the first pressure sensor and the measurement value of the temperature sensor at the time when generation of vapor is detected by the detection unit.

8. A fuel injection control system for an internal combustion engine according to claim 1 further comprising a heating apparatus that heats fuel flowing into the high pressure fuel pump, wherein the detection unit causes the heating apparatus to operate when executing a process of detecting generation of vapor.

9. A fuel injection control system for an internal combustion engine according to claim 1 further comprising a compensation unit that executes at least one of a process of retarding ignition timing, a process of increasing internal EGR gas and a process of raising fuel injection pressure when the saturation vapor pressure calculated by the calculation unit is lower than the saturation vapor pressure of a presupposed standard fuel.

10. A fuel injection control system for an internal combustion engine according to claim 1 further comprising a restriction unit that restricts the output of the internal combustion engine when the saturation vapor pressure calculated by the calculation unit is higher than the saturation vapor pressure of a presupposed standard fuel.

11. A fuel injection control system for an internal combustion engine according to claim 1 further comprising an idle-up control unit that performs increasing correction of the idle speed of the internal combustion engine when the saturation vapor pressure calculated by the calculation unit is higher than the saturation vapor pressure of a presupposed standard fuel.

* * * * *